US012291814B2

(12) United States Patent
Kim et al.

(10) Patent No.: US 12,291,814 B2
(45) Date of Patent: May 6, 2025

(54) LAUNDRY TREATING APPARATUS

(71) Applicant: LG Electronics Inc., Seoul (KR)

(72) Inventors: Hyojun Kim, Seoul (KR); Hongjun Cho, Seoul (KR); Jongmin Lee, Seoul (KR); Hyunwoo Noh, Seoul (KR); Taewoong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 850 days.

(21) Appl. No.: 17/466,733

(22) Filed: Sep. 3, 2021

(65) Prior Publication Data

US 2022/0112645 A1 Apr. 14, 2022

(30) Foreign Application Priority Data

Sep. 4, 2020 (KR) ..... 10-2020-0113175
Sep. 4, 2020 (KR) ..... 10-2020-0113176

(51) Int. Cl.

| | |
|---|---|
| ***D06F 58/08*** | (2006.01) |
| ***D06F 37/04*** | (2006.01) |
| ***D06F 37/22*** | (2006.01) |
| ***D06F 37/40*** | (2006.01) |
| ***D06F 58/06*** | (2006.01) |
| ***D06F 58/26*** | (2006.01) |

(52) U.S. Cl.

CPC ..... *D06F 58/08* (2013.01); *D06F 37/04* (2013.01); *D06F 37/22* (2013.01); *D06F 37/40* (2013.01); *D06F 58/06* (2013.01); *D06F 58/26* (2013.01)

(58) Field of Classification Search

CPC ..... D06F 58/08
See application file for complete search history.

(56) References Cited

U.S. PATENT DOCUMENTS

| | | | |
|---|---|---|---|
| 3,167,409 | A | 1/1965 | Brucken |
| 4,407,078 | A | 10/1983 | Takeyama |
| 6,047,486 | A | 4/2000 | Reck et al. |
| 6,199,300 | B1 | 3/2001 | Heater et al. |
| 6,378,228 | B1 | 4/2002 | Maziere |
| 6,493,963 | B1 | 12/2002 | England |
| 7,975,400 | B2 | 7/2011 | Dittmer et al. |
| 8,533,882 | B2 | 9/2013 | Lillie |
| 9,580,860 | B2 | 2/2017 | Bellinger et al. |
| 10,669,668 | B2 | 6/2020 | Goodson et al. |
| 10,889,933 | B2 | 1/2021 | Choi et al. |
| 11,021,837 | B2 | 6/2021 | Bellm et al. |
| 2013/0326825 | A1 | 12/2013 | Lilie |
| 2019/0264377 | A1 | 8/2019 | Choi et al. |

(Continued)

FOREIGN PATENT DOCUMENTS

| | | |
|---|---|---|
| AU | 2019386525 B2 | 6/2020 |
| CN | 1067127 | 12/1992 |
| DE | 3024242 | 4/1981 |

(Continued)

OTHER PUBLICATIONS

Extended European Search Report in European Appln. No. 21194791.6, dated Jan. 24, 2022, 9 pages.

(Continued)

*Primary Examiner* — Jason Y Ko
(74) *Attorney, Agent, or Firm* — Fish & Richardson P.C.

(57) ABSTRACT

A laundry treating apparatus includes a drum for accommodating laundry therein. The drum may be directly coupled to a free end of a rotation shaft extending from a driver for providing power to rotate the drum.

17 Claims, 17 Drawing Sheets

(56) References Cited

U.S. PATENT DOCUMENTS

2021/0404107 A1 12/2021 Bae et al.

FOREIGN PATENT DOCUMENTS

| | | | |
|---|---|---|---|
| EP | 3239383 | | 11/2017 |
| EP | 3889340 | A1 | 10/2021 |
| JP | H08-098995 | | 4/1996 |
| JP | 2003144789 | | 5/2003 |
| JP | 2019017532 | | 2/2019 |
| KR | 20030050286 | | 6/2003 |
| KR | 10-2005-0038494 | | 4/2005 |
| KR | 101047435 | | 7/2011 |
| KR | 101639023 | | 7/2016 |
| KR | 10-2019-0035586 | | 4/2019 |
| KR | 20200065932 | | 6/2020 |
| KR | 20200066169 | | 6/2020 |
| WO | WO2020111817 | | 6/2020 |

OTHER PUBLICATIONS

Extended European Search Report in European Appln. No. 21194822.9, dated Jan. 2, 2022, 9 pages.

International Search Report and Written Opinion in International Appln. No. PCT/KR2021/011946, dated Dec. 27, 2021, 9 pages.

International Search Report and Written Opinion in International Appln. No. PCT/KR2021/011950, dated Dec. 29, 2021, 9 pages.

Office Action in U.S. Appl. No. 17/466,965, mailed on Jul. 19, 2024, 12 pages.

Office Action in Japanese Appln. No. 2023-514794, mailed on Dec. 5, 2023, 8 pages (with English translation).

Office Action in Japanese Appln. No. 2023-514939, mailed on Dec. 5, 2023, 8 pages (with English translation).

Office Action in Korean Appln. No. 10-2020-0113175, mailed on Nov. 23, 2023, 12 pages (with English translation).

Office Action in Korean Appln. No. 10-2020-0113176, mailed on Dec. 12, 2023, 14 pages (with English translation).

(a)

(b)

(a) (b)

LAUNDRY TREATING APPARATUS

CROSS-REFERENCE TO RELATED APPLICATIONS

This application claims the benefit of Korean Patent Application Nos. 10-2020-0113175, filed on Sep. 4, 2020, and 10-2020-0113176 Filed on Sep. 4, 2020, the disclosures of which are hereby incorporated by reference as if fully set forth herein.

TECHNICAL FIELD

The present disclosure relates to a laundry treating apparatus.

BACKGROUND

A laundry treating apparatus, which is an apparatus capable of removing dust or foreign matters attached to laundry by applying a physical force to the laundry, includes a washing machine, a dryer, a refresher (styler), and the like.

The washing machine is provided to perform a washing process capable of separating and removing the foreign matters of the laundry by supplying water and detergent to the laundry.

Dryers are divided into exhaust-type dryers and circulation-type dryers. The exhaust-type dryers and the circulation-type dryers are commonly provided to perform a drying process to remove moisture contained in the laundry by producing high-temperature hot air through a heater and exposing the hot air to the laundry.

Recently, the dryer is provided to intensively perform a drying process by omitting a component for supplying or draining water into or from the laundry and also omitting a tub for accommodating the water inside a cabinet. Therefore, there was an advantage of improving drying efficiency by directly supplying the hot air to a drum accommodating the laundry therein while simplifying an internal structure of the dryer.

Such dryer may include the drum that accommodates the laundry therein, a hot air supplier that supplies the hot air into the drum, and a driver that rotates the drum. Thus, the dryer was able to dry the laundry accommodated in the drum by supplying the hot air into the drum, and evenly expose a surface of the laundry to the hot air by rotating the drum. As a result, the drying was able to be completed as an entirety of the surface of the laundry is evenly in contact with the hot air.

In one example, the driver needs to be fixed inside the cabinet in order to rotate the drum. In addition, when the driver is provided to rotate a rotation shaft coupled to the drum, the driver was necessary to be coupled in parallel with the rotation shaft. However, as the dryer does not have the tub fixed inside the cabinet, there is a limitation that the driver is not able to be fixed to the tub like the washing machine.

To solve such problem, a dryer that fixes the driver to a rear surface of the cabinet has emerged.

FIG. 1 shows a structure of the related art dryer in which the driver is coupled to the rear surface of the cabinet.

Such dryer may include a cabinet 1 forming an appearance of the dryer, a drum 2 rotatably disposed inside the cabinet 1 for accommodating laundry therein, and a driver 3 provided to rotate the drum 2.

The driver 3 may be disposed on a rear surface of the drum 2 and may be provided to rotate the drum 2, and may be coupled to and fixed to a rear panel 11 forming a rear surface of the cabinet 1. Thus, the driver 3 was able to be fixed to the cabinet 1 and rotate the drum 2.

In the related art dryers described above, the driver 3 was able to commonly include a stator 31 fixed to the rear panel 11, a rotor 32 rotated by the stator 31, and a rotation shaft 33 coupled with the rotor 32 to rotate the drum 2, and include a decelerator 37 provided to rotate the drum 2 by increasing torque while decreasing rpm of the rotation shaft 33.

In addition, the related art dryer commonly further includes a fixing portion 4 for fixing the driver 3 to the rear panel 11. The fixing portion 4 may include at least one of a first fixing portion 41 for fixing the stator 31 to the rear panel 11, and a second fixing portion 42 for fixing the rotation shaft 33 to the rear panel 11. Accordingly, the related art dryers were able to stably rotate the drum 2 by disposing the rotation shaft 33 coupled to the drum 2 and the driver 3 in parallel with each other.

However, because the rear panel 11 of the cabinet is made of a thin steel plate, the rear panel 11 is easily deformed or vibrated even with a fairly small external force. Moreover, because the rear panel 11 receives not only a load of the driver 3, but also a load of the drum 2 through the rotation shaft 33, the rear panel 11 may be difficult to maintain a shape thereof.

In addition, when the laundry inside the drum 2 is eccentric or repeatedly falls inside the drum 2 when the drum 2 rotates, repeated external force may be transmitted to the rear panel 11, so that the rear panel 11 may vibrate.

When the vibration or the external force is transmitted to the rear panel 11 and the rear panel 11 is bent or deformed even temporarily, the rotation shaft 33 connecting the driver 3 to the drum 2 may be distorted. Accordingly, unnecessary vibration or noise may occur in the driver 3, and in severe cases, the rotation shaft 33 may be damaged. In addition, there is a problem in that unnecessary noise is generated while the rear panel 11 is bent or deformed.

In addition, a distance between the rotor 32 and the stator 31 is temporarily changed while the rear panel 11 vibrates, so that the rotor 32 may collide with the stator 31 or the unnecessary vibration and noise are generated.

Moreover, when the driver 3 further includes the decelerator 37, the rotation shaft 33 coupled to the decelerator 37 and a decelerating shaft 33*a* connected from the decelerator 37 to the drum 2 are separated from each other. In this connection, because the decelerator 37 is supported on the rear panel 11 through the stator 31 or the rotation shaft 33, when the rear panel 11 is deformed even a little, the decelerating shaft 33*a* and the rotation shaft 33 may be misaligned or displaced with each other.

In other words, an amount of change in position of the decelerating shaft 33*a* connected to the drum 2 may be smaller than that of the rotation shaft 33 coupled to the driver 3 because of the load of the drum 2. Therefore, when the rear panel 11 is temporarily bent or deformed, degrees of tilting of the rotation shaft 33 and the decelerating shaft 33*a* become different from each other, so that the rotation shaft 33 and the decelerating shaft 33*a* are misaligned with each other.

Therefore, every time the driver 3 operates, because the rotation shaft 33 and the decelerating shaft 33*a* are misaligned with each other, the related art laundry treating apparatus was not able to guarantee reliability of the decelerator 37, and had a problem that the decelerator 37 may be damaged.

In one example, in order to directly connect the driver 3 to the drum 200 in the dryer, it is necessary to couple a rotation shaft that transmits the power of the driver 3 to the drum 200. However, as described above, in the related art dryer, a specific structure for coupling the driver 3 to the drum 200 is not specified, so that it may be considered to apply a structure that couples the drum 200 and driver 3 of the washing machine to each other.

FIG. 2 shows a related art structure for coupling a rotation shaft to a drum.

Referring to (a) in FIG. 2, the related art laundry treating apparatus has a drum rear surface 220 to be coupled to the driver on the rear surface of the drum 20, and has a spider 230 coupled to the drum rear surface 220. The spider 230 is not only fixed to the drum rear surface 220, but also extends to a circumferential surface of the drum to fix the drum 200 and form a rotation shaft 234 for rotating the drum 200.

Accordingly, the drum 200 may have the rotation shaft 234 that protrudes to the outside because of the spider 230, and the driver may be coupled to the rotation shaft 234 to rotate the drum 200 by rotating the rotation shaft.

Referring to (b) in FIG. 2, the spider 230 may be generally fixed by being seated on a coupling surface 227 formed on the drum rear surface 220, and may be fixed by a fixing bolt n or the like. The spider 230 includes a hub 231 coupled to a center of the rear surface 220 of the drum 2, a blade 232 extending radially from the hub 231, a fastening hole 233 protruding from the blade 232 to be fastened to the fixing bolt n, and a rotation shaft 234 that protrudes outward from the hub 231 and extends.

In this connection, the driver may include a motor 63 for rotating the rotation shaft, and a shaft accommodating portion 61 extending from the motor 63 to accommodate and support the rotation shaft. The rotation shaft 234 may be accommodated and supported in the shaft accommodating portion 61, and the shaft accommodating portion 61 may further include a coupling shaft 62 coupled to the rotation shaft 234 to transmit power of the motor 63 to the rotation shaft 234. The coupling shaft 62 may correspond to a separate driving shaft rotated by the motor 63. In the spider 230, a gear shaft 2341 that should be separately coupled to the shaft accommodating portion 61 or the coupling shaft 62 of the driver needs to further extend from the rotation shaft 234.

As a result, the related art laundry treating apparatus has a limitation that, in order to rotate the drum 200, a separate component to accommodate and support the rotation shaft 234 as well as the spider 230 is further required. Accordingly, there is a problem in that lengths of the drum and the driver must be unnecessarily extended because of the above component.

Specifically, because of the spider 230 from which the rotation shaft 234 protrudes, in addition to a thickness D of the motor 63, which is an essential component for generating the power to rotate the drum 200, and a thickness T of the coupling shaft 62, it is necessary to further secure an own length A1 of the rotation shaft 234 and a support length A2 of the shaft accommodating portion 61 that needs to support the rotation shaft.

In other words, there is a problem in that an additional length A including the own length A1 of the unnecessarily extending rotation shaft 234 and the support length A2 of the shaft accommodating portion 61 that needs to accommodate and support the rotation shaft 234 therein must be secured unnecessarily.

In this connection, a length in a front and rear direction of the cabinet is limited, so that there is a problem in that the length of the drum 200 is reduced by the additional length A, which results in reduction of a laundry accommodation volume. In one example, when the spider 230 is depressed and accommodated in the drum rear surface 220, although the thickness of the driver may be further reduced that much, there is a problem that a washing volume inside the drum is still reduced.

Moreover, when the laundry treating apparatus is formed as the dryer, the driver of the dryer should have the decelerator that reduces the rotation speed of the motor 63 and increases the torque.

In general, the decelerator is provided to accommodate both shafts and change RPMs of the both shafts. Therefore, when the decelerator is disposed to rotate the drum coupled to the spider 230, the decelerator should also accommodate and support the rotation shaft 234 protruding from the drum 200, and should also accommodate and support the coupling shaft 62 coupled to the motor 63, so that there was a limit that the shaft accommodating portion must be secured that much to support the shafts.

As a result, an overall length of the decelerator is further increased, so that an overall thickness of the driver became greater, and it was not possible to secure sufficient drum volume inside the cabinet.

As a result, when a dryer that directly rotates the rotation shaft protruding from the drum 200 is manufactured, the dryer has a fundamental limitation in that the volume of the drum 200 is not able to be sufficiently secured or the cabinet must be unnecessarily long.

Therefore, in the prior art, because of such a fundamental limitation, the dryer equipped with the driver for directly rotating the drum existed only as a patent document, and an actual product was not able to appear.

SUMMARY

The present disclosure is to provide a laundry treating apparatus in which a rotation shaft does not extend from a drum, but a free end of the rotation shaft that rotates the drum is inserted into and coupled to the drum.

The present disclosure is to provide a laundry treating apparatus in which a rotation shaft may be extended from a driver that generates power and may be directly inserted or accommodated in the drum and coupled to the drum.

The present disclosure is to provide a laundry treating apparatus that may sufficiently secure a length of a drum even when a motor that generates power and a decelerator that may convert the output of the motor and transmit the converted output of the motor are disposed.

The present disclosure is to provide a laundry treating apparatus having a drum that is directly coupled to a free end of a rotation shaft and rotates.

The present disclosure is to provide a laundry treating apparatus having a drum that may mount a bushing for accommodating a free end of a rotation shaft therein on a rear surface of the drum.

The present disclosure is to provide laundry treating apparatus that may reduce overall thicknesses of a motor that generates power and a decelerator.

The present disclosure is to provide a laundry treating apparatus that may maintain a motor that provides rotational power to rotate a drum and a rotation shaft of a decelerator that converts rpm and torque of the rotational power.

The present disclosure is to provide a laundry treating apparatus in which a decelerator and a motor may be tilted or vibrated at the same time.

Particular implementations of the present disclosure provide a laundry treating apparatus that includes a drum configured to accommodate laundry therein, and a driver including a rotation shaft configured to rotate the drum. The drum includes a drum body having a laundry inlet and defining a space configured to accommodate the laundry through the laundry inlet, and a drum rear surface coupled to the drum body. The drum rear surface is coupled to a free end of the rotation shaft of the driver.

In some implementations, the laundry treating apparatus may optionally include one or more of the following features. The free end of the rotation shaft may be received in and coupled to the drum rear surface. The drum may include a bushing portion coupled to the drum rear surface. The free end of the rotation shaft may be coupled to the bushing portion. The drum rear surface may include a circumferential portion coupled to the drum body, and a seating portion extending from the circumferential portion and being coupled to the bushing portion. The seating portion may be recessed toward the laundry inlet from an inner circumferential surface of the circumferential portion. A diameter of the seating portion may be larger than a diameter of the driver. At least a portion of the driver may be received in the seating portion. The seating portion of the drum rear surface may include an accommodating surface extending obliquely from the circumferential portion of the drum rear surface, a support surface extending from an inner circumferential surface of the accommodating surface and facing the driver, and an installation surface disposed at an inner circumferential surface of the support surface. The bushing portion may be seated at the installation surface. The installation surface may include a coupling groove. A fastening member may be coupled to the coupling groove and support the bushing portion or pass through the bush portion. The bushing portion may include a coupling surface coupled to the seating portion of the drum rear surface, and a shaft coupling portion extending from the coupling surface, wherein the free end of the rotation shaft of the driver is coupled to the shaft coupling portion. The shaft coupling portion may receive the free end of the rotation shaft and be coupled to the free end of the rotation shaft. At least a portion of the shaft coupling portion of the bushing portion may be located inside the drum body. The bushing portion may include a recessed surface extending from the coupling surface toward the laundry inlet. The shaft coupling portion of the bushing portion may extend from an inner circumferential surface of the recessed surface of the bushing portion. A first gear may be disposed at the free end of the rotation shaft of the driver. A second gear may be disposed at the shaft coupling portion of the bushing portion and meshed with the first gear disposed at the free end of the rotation shaft of the driver. The shaft coupling portion of the bushing portion may include a coupling plate facing the free end of the rotation shaft of the driver, and a coupling member passing through the coupling plate and coupled to the free end of the rotation shaft of the driver. The coupling surface of the bushing portion may be coupled to an outer surface of the seating portion of the drum rear surface. The laundry treating apparatus may include a plurality of fastening members configured to couple the coupling surface of the bushing portion to the seating portion of the drum rear surface. The bushing portion may include a plurality of bushing coupling portions that radially extend from the coupling surface of the bushing portion. The plurality of fastening members may be coupled to and supported by the plurality of bushing coupling portions respectively. The bushing portion may be made of a material different from a material of the seating portion of the drum rear surface. The driver may include a stator configured to generate a rotating magnetic field, a rotor configured to be rotated by the rotating magnetic field, a driving shaft configured to be rotated by the rotor, and a decelerator coupled to the driving shaft and configured to change a rotational speed and torque of the driving shaft and allow the rotation shaft of the driver to rotate based on the changed rotational speed and torque of the driving shaft. The laundry treating apparatus may include a hot air supplier disposed outside the drum and configured to supply hot air into the drum.

The present disclosure provides a structure that may partially accommodate a driver (a decelerator) on the drum rear surface. A space for partially accommodating the decelerator and the like therein may be defined in the drum rear surface.

The drum and the decelerator or the driver may be coupled in a male-female coupling structure. That is, a rotation shaft may extend from the driver, and the drum may be coupled to the rotation shaft by accommodating a free end of the rotation shaft therein.

The drum may have a separate bushing that may accommodate the free end of the rotation shaft therein, and a portion of the decelerator and at least a portion of a bearing supporting the rotation shaft may be accommodated in a space in which the bushing is disposed.

The bushing may include a pipe extending into the drum to accommodate the rotation shaft therein. The bushing may include a coupling portion formed in a disk shape to be coupled to the drum rear surface.

The pipe may be formed with an insert portion into which an output shaft extending from the decelerator is inserted.

The drum rear surface may include a seating portion recessed into the laundry inlet of the drum, and an installation surface protruding from the seating portion back toward the rear surface of the drum. The seating portion may accommodate portions of the driver and the rotation shaft therein, and the installation surface may accommodate a portion of the bushing therein.

The laundry treating apparatus according to the present disclosure may have a rotating coupling structure of the drum (female)+the driver (male).

Specifically, a structure (the busing) for accommodating the rotation shaft therein may be formed on the drum rear surface.

The bushing coupled with a driver (decelerator) shaft may be disposed at a center of the drum rear surface, and the bushing may include an accommodating groove into which the driver (decelerator) shaft is accommodated and coupled.

The accommodating groove of the bushing may have a serration (a gear groove) defined in an inner circumferential surface. In addition, the rotation shaft may have a serration (a screw gear) matched to the gear groove.

The accommodating groove of the bushing may be recessed into the drum.

The bushing may be recessed inwardly of the rear surface of the drum and coupled to the rear surface of the drum. The bushing may be made of a material having greater rigidity than a material of the rear surface of the drum.

The bushing may have a coupling surface that extends obliquely in a direction of the driver from the accommodating groove to be coupled to the rear surface of the drum, and the bushing may be formed in a cone shape.

In one example, the bushing may have the serration only in the accommodating groove, and the bushing and the drum may be coupled to each other using a bolt or the like.

The laundry treating apparatus according to the present disclosure may include a rear casing capable of supporting a decelerator that converts power output from the driver.

The drum may be disposed on one surface (an inner surface) of the rear casing, and the driver or the decelerator may be disposed on the other surface (an outer surface) of the rear casing.

In order to reduce a volume by which the driver or the decelerator protrudes out of a cabinet rear surface, the rear casing may have a mounting groove recessed into the drum.

A plurality of brackets to which the decelerator is coupled may be coupled and fixed to the mounting groove.

The drum rear surface may be disposed separately and spaced apart from the rear casing.

The drum rear surface may have a seating portion recessed to face the rear casing and the mounting groove.

The seating portion may be partially accommodated in the mounting groove. The seating portion may be formed in a shape corresponding to a shape of the accommodating groove.

The seating portion may also at least partially accommodate the decelerator or the driver.

The driver may include a motor composed of a stator and an outer rotor.

The decelerator may be at least partially accommodated inside the stator, and the decelerator may be directly coupled to the stator.

The seating portion may have a support surface that is bent inwardly or outwardly such that the bushing is supported on the drum rear surface.

An installation surface bent inwardly or outwardly again from support surface and to which the bushing is coupled may be formed at a center of the seating surface.

The bushing may be coupled to the installation surface using the bolt and the like.

The bushing may include a coupling surface supported on the protruding surface, a recessed surface extending from the coupling surface into the drum, and a shaft coupling portion extending from the recessed surface again toward the outside of the drum and coupled to the shaft.

The bushing may be coupled to the rotation shaft protruding from the decelerator.

The present disclosure has an effect that the rotation shaft does not extend from the drum, but the free end of the rotation shaft that rotates the drum is inserted into and coupled to the drum.

The present disclosure has an effect that the rotation shaft may be extended from the driver that generates the power and may be directly inserted into or accommodated in the drum.

The present disclosure has an effect of sufficiently securing the length of the drum even when the motor that generates the power and the decelerator that may convert the output of the motor and transmit the converted output of the motor are disposed.

The present disclosure has an effect of having the drum that is directly coupled to the free end of the rotation shaft and rotates.

The present disclosure has an effect of having the drum that may mount the bushing for accommodating the free end of the rotation shaft therein on the drum rear surface.

DETAILED DESCRIPTION

Figure 1:
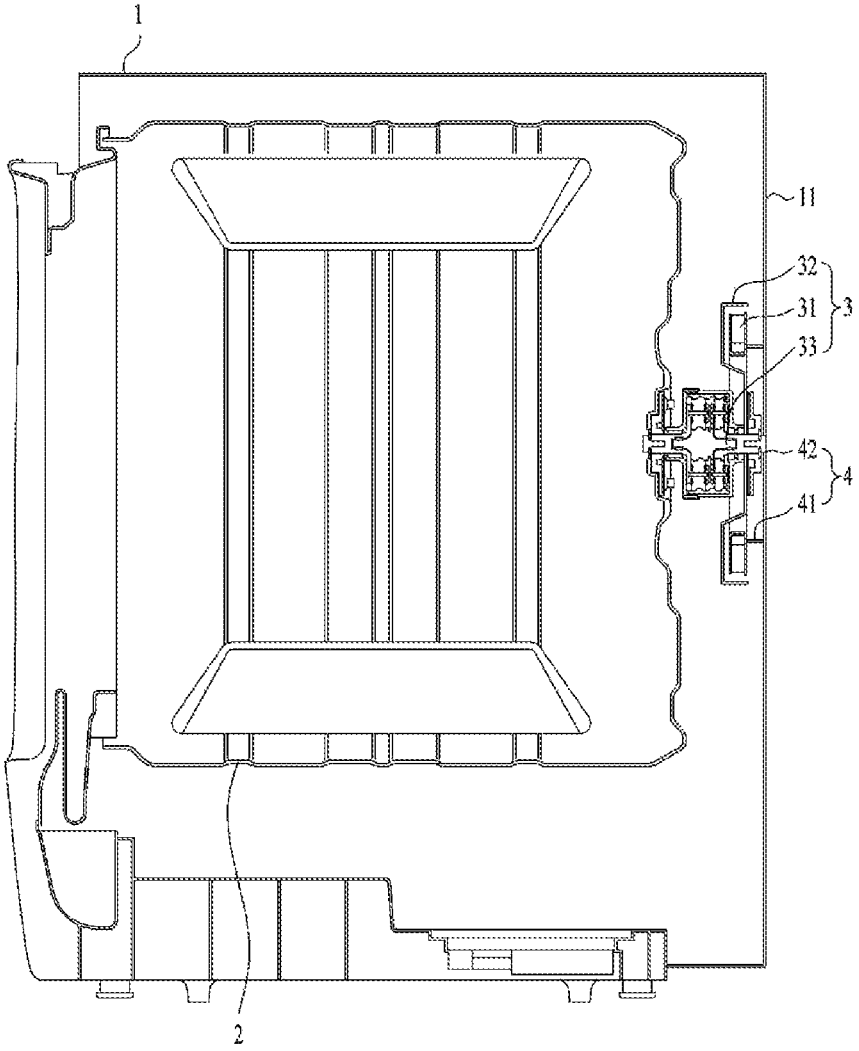
FIG. 1 shows a related art laundry treating apparatus.
Figure 2:
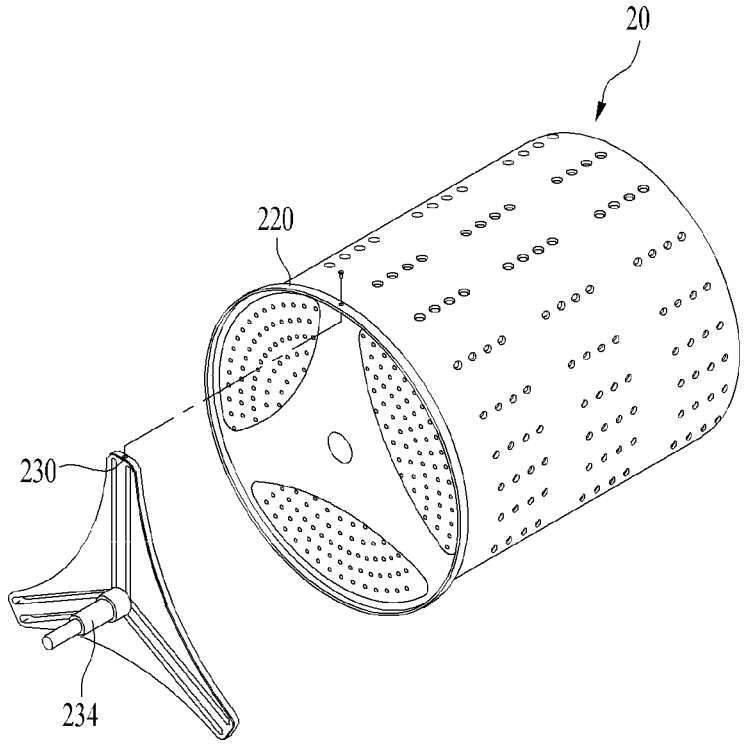
FIG. 2 shows a coupling structure in which a drum of a related art laundry treating apparatus is male and a driver is female.
Figure 2:
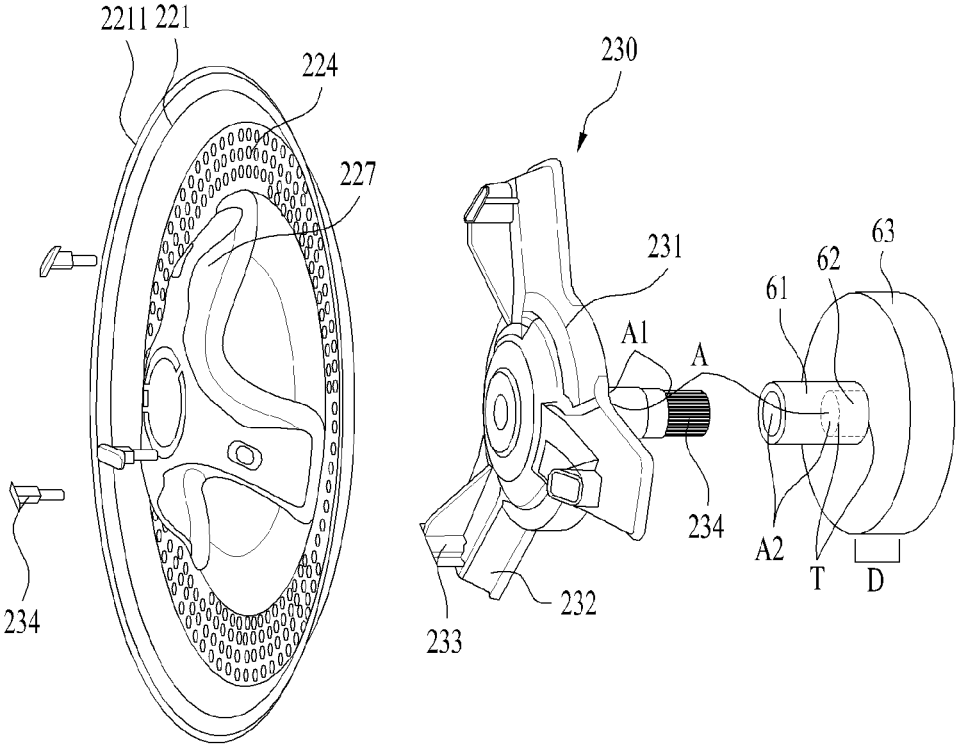

Hereinafter, embodiments disclosed herein will be described in detail with reference to the accompanying drawings. In this specification, even in different embodiments, the same and similar reference numerals are assigned to the same and similar components, and the description thereof is replaced with the first description. As used herein, the singular expression includes the plural expression unless the context clearly dictates otherwise. In addition, in describing the embodiments disclosed herein, when it is determined that detailed descriptions of related known technologies may obscure the gist of the embodiments disclosed herein, the detailed description thereof will be omitted. In addition, the accompanying drawings are only for easy understanding of the embodiments disclosed herein, and it should be noted that the technical idea disclosed herein should not be construed as being limited by the accompanying drawings.

Figure 3:
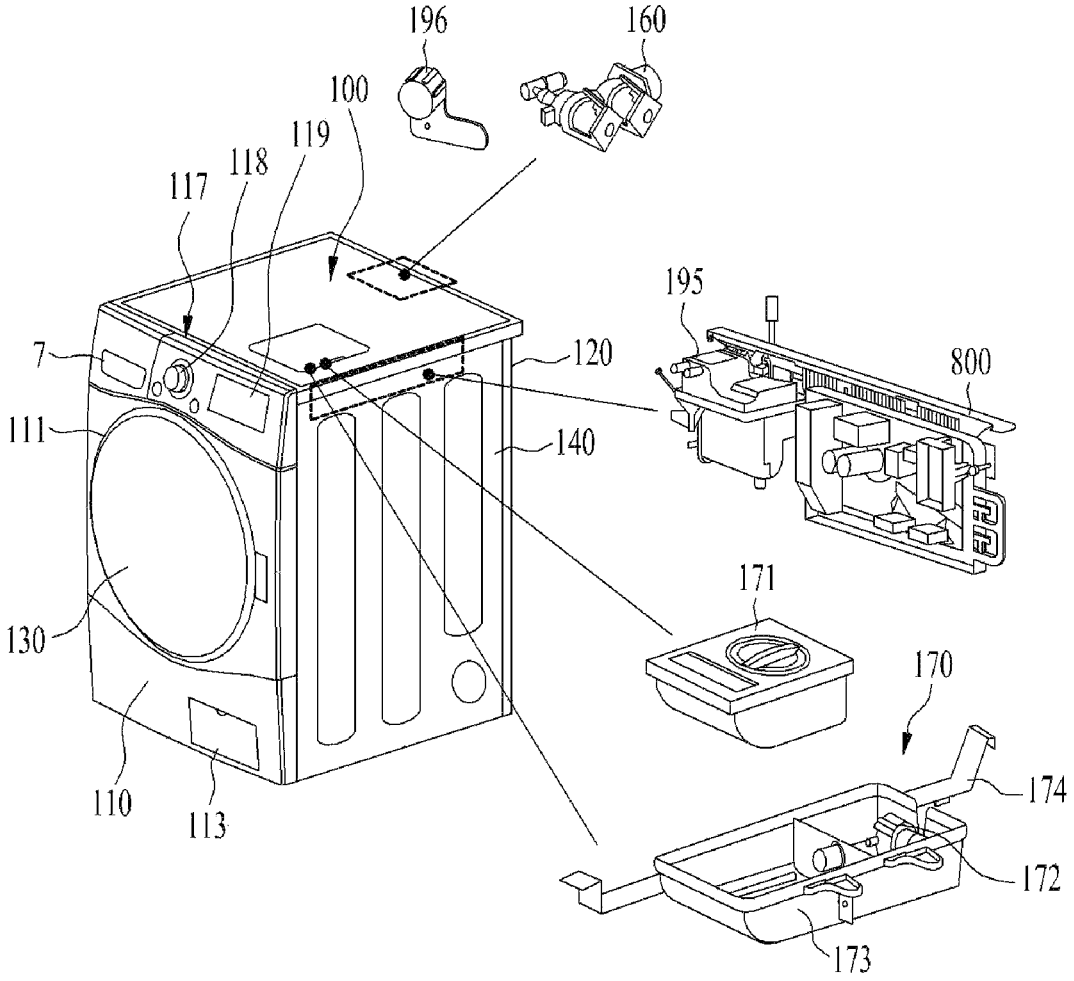
FIG. 3 shows an appearance of a laundry treating apparatus 10 according to the present disclosure.

FIG. 3 shows an appearance of a laundry treating apparatus 10 according to the present disclosure.

The laundry treating apparatus according to an embodiment of the present disclosure may include a cabinet 100 that forms the appearance thereof.

The cabinet 100 may include a front panel 110 defining a front surface of the laundry treating apparatus. The front panel 110 may have a laundry inlet 111 defined therein to communicate with a drum 200 to be described later, and a door 130 pivotally coupled to the cabinet to open and close the laundry inlet 111.

A control panel 117 may be installed on the front surface 110. The control pane 117 may include an input unit 118 for receiving a control command from a user, and a display 119 for outputting information such as a control command selectable by the user. The control command may include a drying course or a drying option capable of performing a series of drying processes. A main controller that controls a command for executing the drying course or the drying option may be installed in the control panel 177.

The input unit 118 may be configured to include a power supply request unit for requesting power supply to the laundry treating apparatus, a course input unit for allowing the user to select a desired course among a plurality of courses, and an execution request unit for requesting start of a course selected by the user.

The display 119 may be configured to include at least one of a display panel capable of outputting a text and a figure, and a speaker capable of outputting an audio signal and a sound.

In one example, the laundry treating apparatus according to the present disclosure may include a water storage 7 provided to separately store therein moisture generated in the process of drying the laundry. The water storage 7 may include a water storage tank provided to be withdrawn from one side of the front surface 110 to the outside. The water storage tank may be provided to collect condensate delivered from a cleaning pump to be described later. Thus, the user may withdraw the water storage tank from the cabinet 1 to remove the condensate therefrom, and then, mount the water storage tank in the cabinet 1 again. Therefore, the laundry treating apparatus according to the present disclosure may be placed in any places where a sewer or the like is not installed.

In one example, the water storage 7 may be disposed above the door 130. Accordingly, when withdrawing the water storage tank from the front surface 110, the user is able to bend a waist relatively less.

In one example, the laundry treating apparatus according to the present disclosure may further include a steam supplier 195 capable of supplying steam to the laundry or into the cabinet. The steam supplier 195 may be provided to generate the steam with the condensate discharged from the laundry, or may be provided to generate the steam by receiving fresh water rather than the condensate. The steam supplier 195 may be provided to generate the steam by heating the water, using ultrasonic waves, or vaporizing the water.

Because the steam supplier 195 is provided to generate the steam by receiving a certain amount of water, the steam supplier 195 may occupy a certain volume. In this connection, the door and the control panel 117 are installed on the front surface 110 of the cabinet, and a duct that supplies or discharges air to/from the drum, a water supply, and the like may be installed on a rear panel 120 of the cabinet, so that the steam supplier 195 may be advantageously installed on an inner surface of a side panel 140 of the cabinet.

In addition, the laundry treating apparatus according to the present disclosure may include a steam controller 80 provided to separately control the steam supplier 195. The steam controller 80 may be installed on the control panel 117, but may be provided as a separate control panel to prevent overloading of the control panel 117 and to prevent increase a production cost.

The steam controller 80 may be disposed adjacent to the steam supplier 195. The steam controller 80 may be disposed on the side panel 140 on which the steam supplier 195 is installed to reduce a length of a control line or the like connected to the steam supplier 195.

Because the steam supplier 195 supplies the steam that may contact the laundry, it is preferable to generate the steam with the fresh water. Because the water collected in the water storage 7 is generated from the laundry, there is a high possibility that lint or foreign matters are contained in the water collected in the water storage 7. Thus, the water collected in the water storage 7 may not be suitable for generating the steam.

Accordingly, the laundry treating apparatus according to the present disclosure may supply the water to the steam supplier 195, but may include a water supplier 160 provided separately from the water storage 7. The water supplier 160 may be provided to store the fresh water therein, or receive the fresh water from the outside and supply the fresh water to the steam supplier 195.

For example, the water supplier 160 may include an external water supplier 180 that may receive water from an external water supply source and deliver the water to the steam supplier 195, and an internal water supplier 170 that may separately store the fresh water therein and supply the fresh water to the steam supplier 195.

The internal water supplier 170 may further include a water tank 171 that is provided separately from the water storage 7 to store the fresh water therein. The laundry treating apparatus according to the present disclosure may also be provided such that the water tank 171 and the steam supplier 195 are installed at different vertical levels, so that the water in the water tank 171 is supplied to the steam supplier 195 by a self load.

When the difference in the installation vertical level between the water tank 171 and the steam supplier 195 is not secured, it may be desirable to additionally install the water pump 172. In addition, when the water pump 172 is additionally disposed, there is an advantage in that a space inside the cabinet 1 may be more densely utilized.

Thus, the water supplier 160 may further include a water pump 172 provided to supply the water in the water tank 171 to the steam supplier 195, and a tank housing 173 that seats the water tank 171 and the water pump 172 inside the cabinet.

The external water supplier 180 may include a direct water valve connected to the external water supply source to receive the water.

In addition, the laundry treating apparatus according to the present disclosure may further include a determination unit 196 that determines whether to supply the water to the steam supplier 195 by preferentially using which of the external water supplier 180 and the internal water supplier 170.

The determination unit 196 may be structurally provided to determine which of the external water supplier 180 and the internal water supplier 170 is preferentially used.

In one example, the water tank 171 may be provided to store the fresh water therein. It is preferable that the water tank 171 is provided to be exposed to the outside of the cabinet 100 to be frequently filled with the fresh water.

In one example, the water tank 171 may be provided to be withdrawn from the cabinet 100. Accordingly, the user may easily fill water by withdrawing the water tank 171 from the cabinet 100.

The water tank 171 may be provided to be withdrawn through the front surface 110. However, when the water storage tank is also provided to be withdrawn through the front surface 110, because of an area occupied by the control panel 117 on the front surface 110, it may be difficult to secure an area for withdrawing the water tank 171.

Accordingly, the water tank 171 may be provided to be withdrawn through the top panel, so that interference with the control panel 117 may be prevented.

From another point of view, because both the water tank 171 and the water storage 7 are provided to store the water therein, the user may be confused. To this end, the laundry treating apparatus according to the present disclosure may be provided such that the water tank 171 and the water storage 7 are exposed from the cabinet in different directions and at different locations.

Thus, the water tank 171 may be provided to be exposed through the top panel, and the water storage 7 may be provided to be exposed through the front surface 110. Therefore, even when both the water tank 171 and the water storage 7 are arranged, the confusion of the user may be prevented. In addition, the water tank 171 may have a relatively smaller volume than the water storage 7 because the water tank 171 must store the fresh water therein and a freshness of the stored water must be maintained. Accordingly, the user may distinguish the water tank 171 and the water storage 7 from each other by the volume difference.

Because the water tank 171 has the smaller volume than the water storage 7, the water tank 171 may be easily withdrawn upward. Accordingly, the water tank 171 may be provided to be withdrawn upward from the top panel. As a result, because the withdrawal directions of the water tank 171 and the water storage 7 are different from each other, the possibility of user confusion may be further reduced.

The top panel of the laundry treating apparatus according to the present disclosure may include a tank withdrawal hole or withdrawal hole 131 defined therein provided such that the water tank 171 may be exposed to the outside or the water tank 171 may be withdrawn to the outside of the cabinet. The tank withdrawal hole 131 may have a cross-sectional area corresponding to or slightly larger than a cross-sectional area of the water tank 171.

The top panel may further include a withdrawal cover 132 provided to shield the tank withdrawal hole 131 to prevent the water tank 171 from being arbitrarily withdrawn.

The laundry treating apparatus according to the present disclosure may further include a filter capable of removing foreign matters from a circulating flow channel. The front surface 110 may have a filter mounting hole 113 defined therein through which the filter is withdrawn or inserted.

Figure 4:
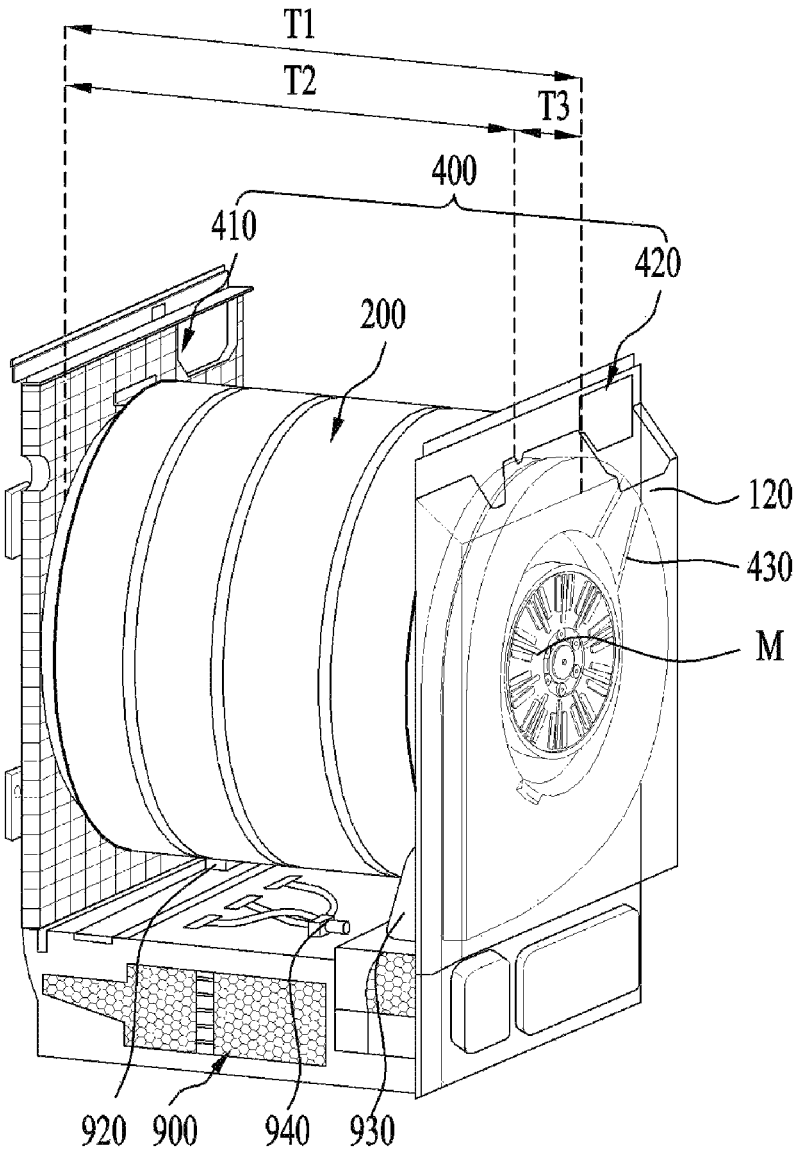
FIG. 4 shows an internal configuration of a laundry treating apparatus according to the present disclosure.

FIG. 4 shows an interior of a laundry treating apparatus according to the present disclosure.

The laundry treating apparatus according to the present disclosure may include the drum 200 accommodated in the cabinet 100 for accommodating the laundry therein, a driver M that rotates the drum 200, and a hot air supplier 900 provided to supply hot air to the drum 200.

The drum 200 may be formed in a cylindrical shape to accommodate the laundry therein. In addition, because there is no need to put water into the drum 200, and the water condensed inside the drum 200 does not need to be discharged to the outside, a through-hole defined along a circumference of the drum 200 may be omitted.

The driver M may be disposed in direct connection with the drum 200 to rotate the drum 200. For example, the driver M may be of a direct drive unit (DD)-type. Accordingly, the driver M may control a rotation direction of the drum 200 or a rotation speed of the drum 200 by directly rotating the drum 200 by omitting a component such as a belt, a pulley, and the like.

In general, in a case of a DD-type washing machine, the driver M may be coupled to and fixed to a tub accommodating the drum 200 therein, and the drum 200 may be coupled to the driver M and supported by the tub. However, because the laundry treating apparatus according to the present disclosure is provided to intensively perform the drying process, the tub fixed to the cabinet 100 to accommodate the drum 200 therein is omitted.

Accordingly, the laundry treating apparatus according to the present disclosure may further include a support 400 provided to fix or support the drum 200 or the driver M inside the cabinet 100.

The support 400 may include a front casing 410 disposed in front of the drum 200 and a rear casing 420 disposed at the rear of the drum 200. The front casing 410 and the rear casing 420 may be formed in a plate shape and respectively disposed to face front and rear surfaces of the drum 200. A distance between the front casing 410 and the rear casing 420 may be the same as a length of the drum 200 or may be set to be larger than the length of the drum 200. The front casing 410 and the rear casing 420 may be fixed to and supported by a bottom surface of the cabinet 100 or the hot air supplier 900 to be described later.

Because the laundry inlet of the drum 200 is defined in a front surface of the drum 200, the driver M is preferably installed in the rear casing 420 rather than in the front casing. The rear casing 420 may be provided such that the driver M is mounted and supported in a region thereof facing the rear surface of the drum 200. Accordingly, the driver M may be provided to rotate the drum 200 in a state in which a position thereof is stably fixed through the rear casing 420.

At least one of the front casing 410 and the rear casing 420 may rotatably support the drum 200. At least one of the front casing 410 and the rear casing 420 may rotatably accommodate a front end or a rear end of the drum 200 therein.

For example, a front portion of the drum 200 may be accommodated and rotatably supported in the front casing 410, and a rear portion of the drum 200 may be spaced apart from the rear casing 420 and may be indirectly supported by the rear casing 420 by being connected to the driver M. Accordingly, a region in which the drum 200 is in contact with or rubbed against the support 400 may be minimized, and unnecessary noise or vibration may be prevented from occurring.

In one example, the drum 200 may be provided to be rotatably supported by both the front casing 410 and the rear casing 420.

The hot air supplier 900 may define the circulating flow channel for discharging air in the drum 200 to the outside and introducing air into the drum 200, and may dry the laundry accommodated in the drum 200 by heating the circulating air or condensing moisture of the circulating air.

It is preferable that the hot air supplier 900 is disposed below the drum 200 such that the laundry inlet of the drum 200 is disposed at a relatively high position, and the user is able to easily withdraw the laundry located inside the drum 200.

The hot air supplier 900 may have a plurality of heat exchangers installed therein that cool or heat the air flowing therein, and may have a washer 940 installed therein that removes foreign matters attached to the heat exchangers using condensate condensed in the air.

The hot air supplier 900 may be provided to receive the air inside the drum 200 through the front casing 410 and discharge the air toward the rear casing 420.

A duct cover 430 that guides the hot air supplied from the hot air supplier 900 to the rear surface of the drum 200 may be coupled to the rear casing 420. The duct cover 430 may be provided to expose the driver M to the outside to cool the driver M. The cabinet 100 may further include a blocking plate 120 that prevents a safety accident by preventing the duct cover 430 and the driver M from being exposed to the outside.

A length T1 in a front and rear direction of the cabinet may be defined as a length from the front casing 410 to the rear panel 120. Strictly speaking, a length from the front panel 110 to the rear panel 120 is the length of the cabinet. However, because the length from the front casing 410 to the rear panel 120 corresponds to an allowable space in which internal components of the laundry treating apparatus according to the present disclosure may be installed, a length of the allowable space (T1=allowable length) may be briefly referred to as the length of the cabinet.

When the allowable length T1 is determined, a length T2 of the drum 200 and a length T3 of the driver may be determined. In addition, the allowable length T1 may include the drum length T2 and the driver length T3, and may be equal to or smaller than a sum of the drum length T2 and the driver length T3.

In one example, when the rear panel 120 is omitted, the rear casing 420 may form a rear surface of the cabinet.

Figure 5:
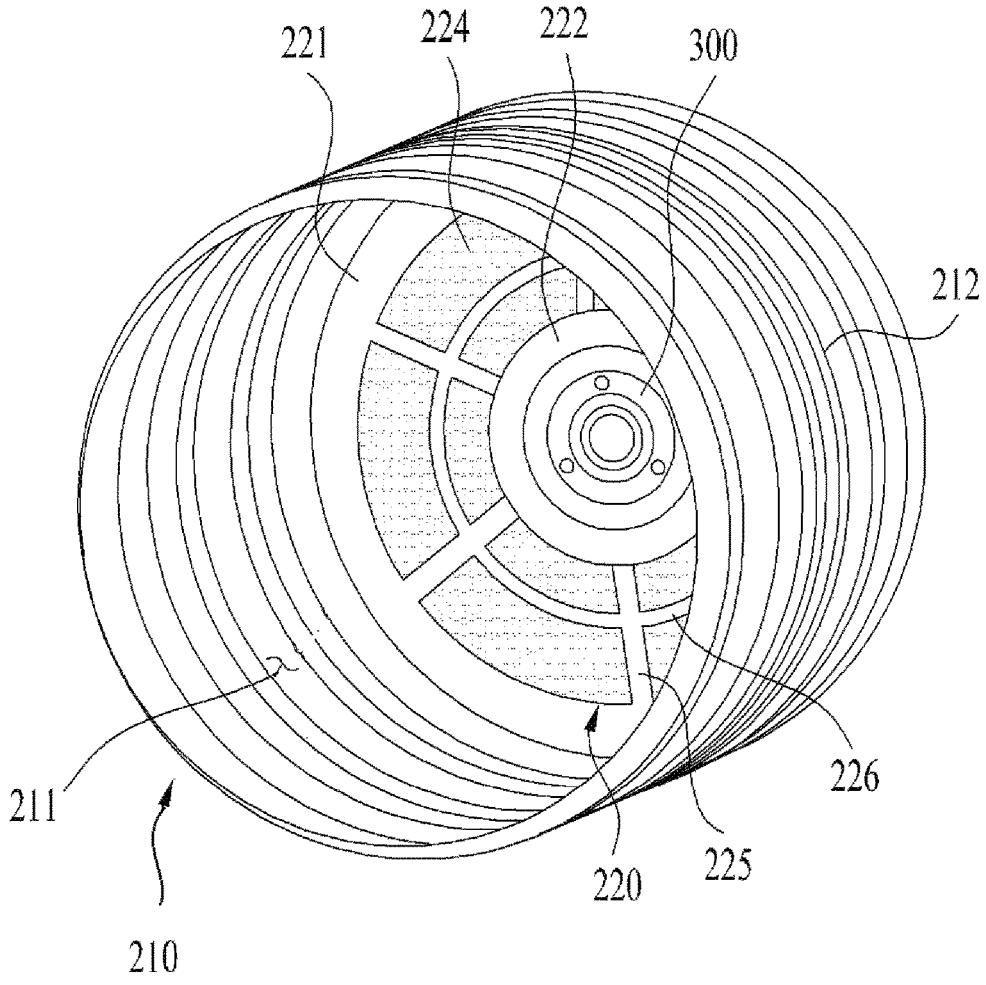
FIG. 5 shows a drum of a laundry treating apparatus according to the present disclosure.

FIG. 5 shows a drum of a laundry treating apparatus according to the present disclosure.

The drum 200 of the laundry treating apparatus according to the present disclosure is rotated by being directly coupled to the driver M rather than being indirectly rotated by being coupled to the belt or the like. Therefore, unlike a drum of a related art dryer formed in a cylindrical shape with open front and rear surfaces, the drum 200 of the laundry treating apparatus according to the present disclosure is provided to be directly coupled to the driver M as the rear portion of the drum 200 is shielded.

Specifically, the drum 200 may include a drum body 210 formed in a cylindrical shape for accommodating the laundry therein, and a drum rear surface 220 coupled to a rear end of the drum body 210 to form the rear surface of the drum.

The drum rear surface 220 may be provided to shield a rear portion of the drum body 210 to provide a space directly coupled to the driver M. That is, the drum rear surface 220 may be provided to rotate the drum body 210 by being connected to the driver M and directly receiving power from the driver M. As a result, a laundry inlet 211 into which the laundry is put may be defined in a front surface of the drum body 210, and the rear portion of the drum body 210 may be shielded by the drum rear surface 220.

The drum rear surface 220 may have a bushing portion 300 that may be coupled to the driver M. The bushing portion 300 may be disposed in the drum rear surface 220 to form a rotation center of the drum 200. The bushing portion 300 may be formed integrally with the drum rear surface 220, but may be made of a material more rigid or durable than a material of the drum rear surface 220 in order to be firmly coupled to a rotation shaft extending from the driver M. The bushing portion 300 may be seated and coupled to a center of the drum rear surface 220.

The drum rear surface 220 may include a circumferential portion 221 coupled to an outer circumferential surface of the drum body 210 and a seating portion 223 disposed inwardly of the circumferential portion 221 and able to be coupled to the driver M. The bushing portion 300 may be accommodated in and coupled to the seating portion 223, and the seating portion 223 may include a through-hole defined therein through which the bushing portion 300 may pass and be accommodated.

A suction hole 224 that guides the hot air supplied from the hot air supplier 900 to be introduced into the drum body 210 may be defined between the circumferential portion 221 and the seating portion 223. The suction hole 224 may be composed of a plurality of holes defined to pass through the drum rear surface 220 or may be formed as a mesh-type net.

In order to prevent rigidity of the drum rear surface 220 from being reduced because of the suction hole 224, reinforcing ribs 225 that reinforce the rigidity of the drum rear surface 220 may be further disposed. The reinforcing ribs 225 may extend radially from an outer circumferential surface of the seating portion 223 toward an inner circumferential surface of the circumferential portion 221. In addition, a circumferential rib 226 extending in a circumferential direction of the drum rear surface 220 may be further disposed to connect the reinforcing ribs 225 to each other. The suction holes 224 may be defined between the reinforcing ribs 225, the circumferential rib 226, the seating portion 223, and the circumferential portion 221, and may maintain a shape thereof through the reinforcing ribs 225 and the circumferential ribs 226 even when the drum rear surface 220 receives a rotational force transmitted from the driver M.

In one example, one or more reinforcing beads 212 may be disposed on an outer circumferential surface of the drum body 210 to reinforce rigidity of the drum body 210. The reinforcing beads 212 may be recessed inwardly or protrude outwardly along a circumference of the drum body 210. The plurality of reinforcing beads 212 may be disposed to be spaced apart from each other in a longitudinal direction of the drum body 210.

Accordingly, even when a large amount of laundry is accommodated in the drum body 210 or the sudden rotational force is transmitted through the driver M, the drum body 210 may be prevented from being twisted.

As a result, the drum 200 of the laundry treating apparatus according to the present disclosure may not be rotated by the belt or the like, but may be rotated as the drum rear surface 220 is directly coupled to the driver M.

Therefore, even when the driver M changes a rotation direction or has a great rotational acceleration, the drum 200 of the laundry treating apparatus according to the present disclosure may be rotated by immediately reflecting this.

Figure 6:
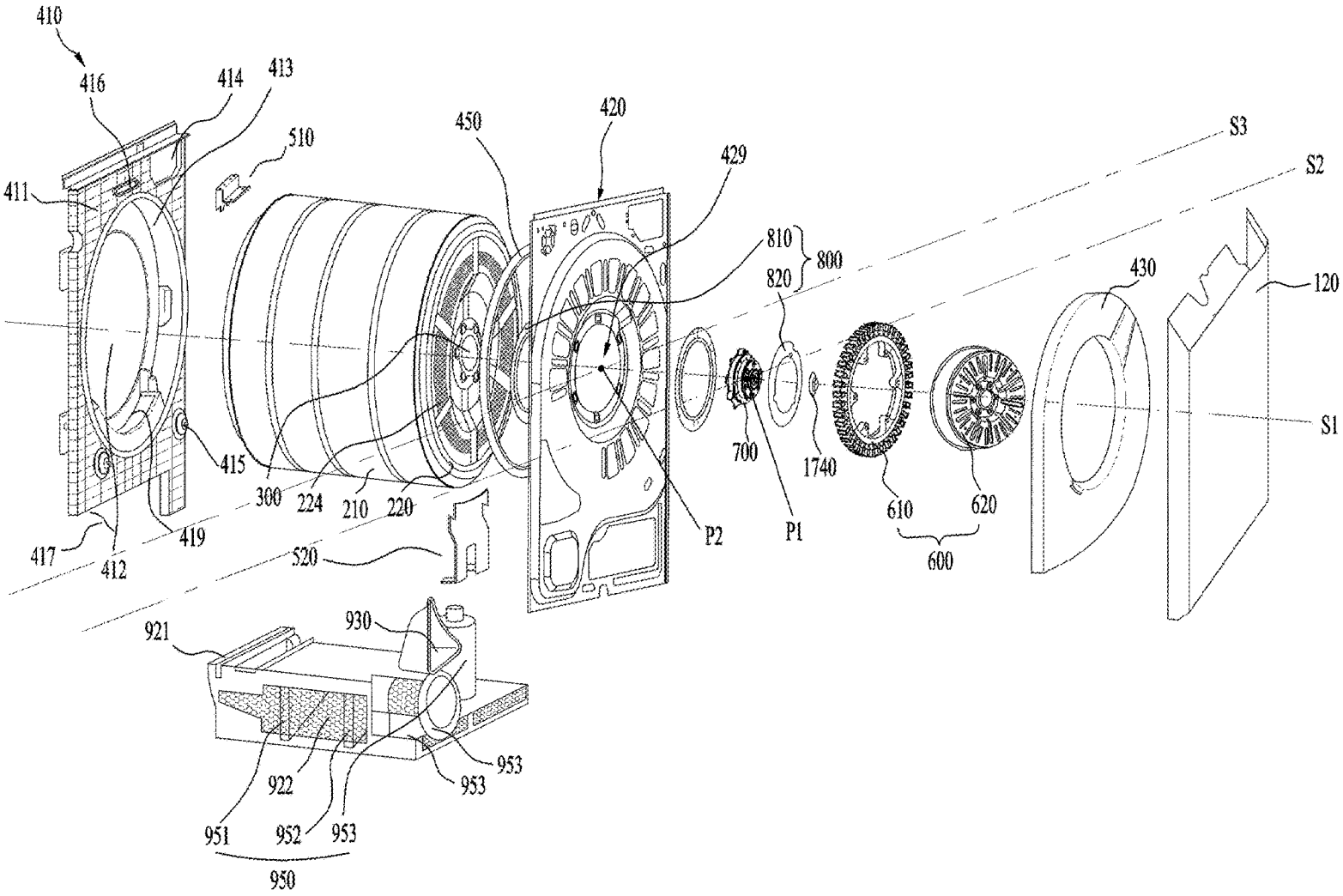
FIG. 6 shows an internal structure of a laundry treating apparatus according to the present disclosure.

FIG. 6 shows an internal configuration of a laundry treating apparatus according to the present disclosure.

As described above, the drum 200 may include the drum body 210 that is formed in the cylindrical shape with the open front and rear surfaces, and the drum rear surface 220 coupled to the rear end of the drum body 210 to shield the rear portion of the drum body 210.

The rotation shaft extending from the driver M may be directly coupled to the bushing portion 300.

The front casing 410 may include a front plate 411 that forms a main body, and an inlet communication hole 412 that penetrates the front plate 411 to accommodate the front portion of the drum body 210 or the laundry inlet 211. A gasket 413 that accommodates the drum body 210 therein may be disposed on an outer circumferential surface of the inlet communication hole 412.

The gasket 413 may rotatably support the laundry inlet 211 of the drum body 210, and may be disposed to be in contact with the outer circumferential surface of the laundry inlet 211. The gasket 413 may prevent the hot air inside the drum 200 from leaking between the drum body 210 and the front plate 411. The gasket 413 may be made of a plastic resin-based material or may be formed as an elastic body. A separate sealing member may be additionally coupled to an inner circumferential surface of the gasket 413 to prevent the laundry or the hot air from deviating from the laundry inlet 211 of the drum body 210 to the front plate 411.

In one example, a duct communication hole 419 in communication with the drum body 210 and through which the air put into the drum body 210 may be discharged may be defined in an inner circumferential surface of the gasket 413 or the inlet communication hole 412. A flow channel that connects the duct communication hole 419 to the hot air supplier 900 may be defined in the front plate 411. Accordingly, the duct communication hole 419 may guide the air discharged from the drum body 210 to be supplied to the hot air supplier 900.

A filter member that blocks the foreign matters, lint, or the like discharged from the drum 200 from being put into the hot air supplier 900 may be installed in the duct communication hole 419.

A front wheel 415 which is disposed to be in contact with the outer circumferential surface of the drum body 210 to rotatably support the drum 200 may be installed on the front casing 410. The front wheel 415 may be provided to support the outer circumferential surface of the laundry inlet of the drum body 210, and may include a plurality of front wheels disposed to be spaced apart from each other along an outer circumferential surface of the inlet communication hole 412. The front wheel 415 may be provided to rotate together when the drum 200 rotates while supporting a lower portion of the drum body 210.

In addition, a stopper 500 that prevents the drum body 210 from deviating may be coupled to the front casing 410. The stopper 500 may be disposed on a stopper installation portion 416 disposed on the front casing 410 and above the inlet communication hole 412.

The front casing 410 may have a tank support hole 414 defined therein through which the water storage tank of the water storage 7 may be withdrawn or supported. The tank support hole 414 may be installed in a region corresponding to a portion where the water storage 7 is disposed in the front surface 110, and may be defined through the front casing 410.

A cutout 417 capable of being supported by the hot air supplier 900 may be defined at a bottom of the front casing 410. Because of the cutout 417, the front casing 410 may be prevented from interfering with the hot air supplier 900. The cutout 417 may be provided to be in communication with a supply duct of the hot air supplier 900 to transfer the air inside the drum supplied to the duct communication hole 419 to the hot air supplier 900.

The hot air supplier 900 may include a circulating flow channel 920 through which the air discharged from the drum 200 may circulate. The circulating flow channel 920 may be formed in a shape of a duct disposed outside the drum 200. The circulating flow channel 920 may include a supply duct 921 in communication with the duct communication hole 419 and through which the air of the drum 200 is supplied, a flow duct 922 through which the air supplied from the supply duct 921 flows, and a discharge duct 923 through which the air that has passed through the flow duct 922 is discharged.

The supply duct 921 may be disposed to be in communication with the cutout 417 of the front casing 410 to be in communication with the flow channel installed inside the front casing 410. The flow duct 922 may be provided to extend from a distal end of the supply duct 921 toward the rear portion of the drum 200, and the discharge duct 923 may be disposed at a distal end of the flow duct 922 to guide the air to the drum 200.

In one example, the hot air supplier 900 may have a heat pump 950 installed therein capable of cooling and heating air therein. The heat pump 950 may include an evaporator 951 installed inside the flow duct 922 to cool the air to condense the moisture contained in the air, and a condenser 952 disposed to be spaced apart from the evaporator 951 downstream or toward the discharge duct 923 to heat the air again. The heat pump 950 may further include an expansion valve that cools a refrigerant that has passed through the condenser 952 and guides the refrigerant back to the evaporator 951, and a compressor 953 that pressurizes and heats the refrigerant that has passed through the evaporator 951 and supplies the pressurized and heated refrigerant to the condenser 952. The compressor 953 may be disposed outside the flow duct 922.

The evaporator 951 and the condenser 952 may be provided as a heat exchanger through which the refrigerant flows.

The hot air supplier 900 may further include a connector 930 that is in communication with the discharge duct 923 to guide the hot air to the rear portion of the drum 200 or to the duct cover 430. The connector 930 may be disposed above the discharge duct 923 to guide the hot air heated through the condenser 952 to a portion at the rear of the discharge duct 923.

In one example, the hot air supplier 900 may further include a blower fan 9531 that may flow the air inside the drum 200 to the supply duct 921 or put the air that has passed through the discharge duct 923 into the drum 200. The blower fan 9531 may be installed inside the discharge duct 923 and may be controlled together with the driver M by the main controller.

The rear casing 420 may include a rear plate 421 disposed to face the front plate 411. The rear casing 420 may include a mounting portion 429 to which the driver M is coupled and seated. The mounting portion 429 may be provided to pass through the rear casing 420, and the driver M may be mounted on the mounting portion 429 and fixed inside the cabinet 100. The mounting portion 429 may support a load of the driver M, and may install the driver M at a position corresponding to a position of the drum rear surface 220.

In one example, the rear plate 421 may further include an air flow hole 423 in communication with the connector 930 and through which the air is introduced, and a communication hole 424 that discharges the air that has passed through the air flow hole 423 to the drum rear surface 220.

The duct cover 430 that defines a flow channel for flowing the air introduced through the connector 930 to the suction hole 224 defined in the drum rear surface 220 may be coupled to a rear surface of the rear plate 421.

The duct cover 430 may be coupled to the rear plate 421 and may be spaced apart from the suction hole 224 to define a space in which the air flows between the rear plate 421 and the duct cover 430.

The duct cover 430 may be disposed to shield the communication holes 424 such that all the communication holes 424 are not exposed to the outside. Accordingly, an entirety of the air introduced into the duct cover 430 may be discharged to the communication holes 424 and may be prevented from leaking to the outside. The duct cover 430 may accommodate the driver M by being spaced apart from an outer circumferential surface of the driver M to prevent interference with the driver M, but may expose the driver M to the outside to induce cooling of the driver M.

In one example, the duct cover 430 may be heated by the hot air, and the driver M also has a rotating rotor, so that the rear panel 120 may be disposed at the rear of the duct cover 430 to shield the driver M. The rear panel 120 may be coupled to the rear casing 420 to block the duct cover 430 and the driver M from being exposed to the outside. The rear panel 120 may be disposed to be spaced apart from the duct cover 430 and the driver M.

The driver M may include a motor 600 that provides power to rotate the drum 200. The motor 600 may include a stator 610 that generates a rotating magnetic field, and a rotor 620 that is rotated by the stator 610.

The rotor 620 may be of an outer rotor type for accommodating the stator 610 therein and rotating along a circumference of the stator 610. In this connection, the rotation shaft may be coupled to the rotor 620 and may be directly connected to the drum 200 through the stator 610 and the mounting portion 429. In this case, the rotor 620 may directly transmit the power to rotate the drum 200.

In one example, the rotor 620 may rotate at high RPM by the stator 610. For example, the rotor 620 may rotate at RPM much greater than RPM at which the laundry inside the drum 200 is able to rotate while being attached to an inner wall of the drum 200.

However, when the laundry inside the drum 200 is rotated while being continuously attached to the inner wall of the drum 200, there is a problem in that drying efficiency decreases because a portion of the laundry attached to the inner wall of the drum is not exposed to the hot air.

When the rotor 620 is rotated at low RPM to roll or agitate the laundry inside the drum 200 without attaching the laundry inside the drum to the inner wall of the drum 200, there may be a problem in that an output or a torque that may be generated by the driver M is not able to be properly utilized.

Accordingly, the driver M of the laundry treating apparatus according to the present disclosure may further include a decelerator 700 capable of increasing the torque while utilizing a maximum output of the motor 600 by reducing the RPM.

The decelerator 700 may be provided to connect the motor 600 to the drum 200. The decelerator 700 may convert the power of the motor 600 to rotate the drum 200. The decelerator 700 may be disposed between the motor 600 and the drum 200 to receive power from the motor 600, convert the power, and transmit the converted power to the drum 200. The decelerator 700 is provided to convert the RPM of the rotor into small RPM, but increase the torque value and transmit power corresponding to the decreased RPM and the increased torque value to the drum 200.

Specifically, the decelerator 700 may be coupled to a driving shaft 630 that extends from the rotor 620 and rotates together with the rotor 620. The decelerator 700 includes a gearbox that rotates in engagement with the driving shaft 630 to change rpm of the driving shaft 630 but increase the torque, and the gearbox is coupled to a rotation shaft 740 that is coupled to the drum 200 to rotate the drum. Accordingly, when the driving shaft 630 rotates, the rotation shaft 740 rotates at RPM smaller than that of the driving shaft 630 but may rotate with a greater torque.

A performance of such decelerator 700 depends on whether the driving shaft 630 and the rotation shaft 740 may be remained coaxial with each other. That is, when the driving shaft 630 and the rotation shaft 740 are misaligned with each other, there is a risk that coupling of components constituting the gearbox inside the decelerator 700 to at least one of the driving shaft 630 and the rotation shaft 740 may loosen or may be released. Accordingly, the power of the driving shaft 630 may not be properly transmitted to the rotation shaft 740 or the driving shaft 630 may be in vain.

In addition, even when the driving shaft 630 and the rotation shaft 740 are temporarily misaligned, the gearboxes inside the decelerator 700 may be misaligned with each other and collide with each other, thereby generating unnecessary vibration or noise.

In addition, even when an angle at which the driving shaft 630 and the rotation shaft 740 are misaligned with each other becomes temporarily greater, there is a risk that the gearbox inside the decelerator 700 may completely deviate from a regular position thereof or be damaged.

As a result, even when the driving shaft 630 and the rotation shaft 740 are not remained coaxial with each other or not arranged side by side to each other temporarily, there may be a problem that the performance of the decelerator 700 is not able to be guaranteed and the drum 200 is not able to be rotated as intended.

To this end, laundry treating apparatuses having the decelerator generally fix the decelerator and the motor to a support body that maintains an original state thereof without deformation even when an external force is generated.

For example, the washing machine may apply a scheme of primarily fixing the tub accommodating the drum therein to the cabinet, and then secondarily fixing the motor and the decelerator to a bearing housing made of a rigid body embedded in the tub in an injection molding scheme. In addition, a scheme of placing a fixed steel plate coupled to the tub outside the tub, and fixing the motor and the decelerator to the fixed steel plate may be applied.

Accordingly, even when significant vibration occurs in the tub, the decelerator and the driver may tilt or vibrate together with the bearing housing or the fixed steel plate. As a result, the decelerator and the driver themselves may be always coupled to each other, and the driving shaft and the rotation shaft may be remained coaxial with each other.

However, because the laundry treating apparatus according to the present disclosure is formed as the dryer, the tub fixed inside the cabinet is omitted. In addition, even when the rear panel 120 of the cabinet is formed as a relatively thin plate, and the stator 610 is fixed thereto, the rear panel 120 may easily vibrate or bend because of a repulsive force when the rotor 620 rotates or the driving shaft 630 rotates. When the rear panel 120 vibrates or bends even temporarily, the rotation shaft 740 and the driving shaft 630 that are disposed to be coupled to the drum 200 are bent, so that the rotation shaft 740 and the driving shaft 630 may be misaligned with each other.

In addition, because the rear panel 120 is formed as the thin steel plate, the rear panel 120 may be impossible to support both the decelerator 700 and the motor 600. For example, when the decelerator 700 and the motor 600 are coupled to the rear panel 120 in parallel, a rotational moment is generated because of a total length and self loads of the decelerator 700 and the motor 600, so that the decelerator 700 may sag downward. As a result, the rotation shaft 740 itself coupled to the drum may be misaligned with the decelerator 700, so that the rotation shaft 740 may not be remained coaxial with the driving shaft 630.

Even the rear panel 120 may not be able to support the motor 600 itself. One surface on which the motor 600 is installed of the rear panel 120 may bend downward by the self load of the motor 600. From the beginning, the rear panel 120 may not be a component suitable for coupling with the motor 600 itself.

In one example, it may be considered that the motor 600 is supported as the stator 610 is coupled to the rear casing 420. When the large amount of laundry is accommodated inside the drum 200 or eccentricity occurs, the rotation shaft 740 may be misaligned along disposition of the laundry whenever the drum 200 rotates. In this connection, because the stator 610 is separated from the drum 200 and fixed to the rear casing 420, the rotation shaft 740 may vibrate with an amplitude different from that of the stator 610 or may tilt at an angle different from that of the stator 610. Accordingly, the rotation shaft 740 may not be remained coaxial with the driving shaft 630.

From another point of view, the drum 200 may be supported by the front casing 410 and the rear casing 420, or a position at which the drum 200 is installed may be fixed at a certain level by a stopper 500 to be described later. Accordingly, a position of the rotation shaft 740 coupled to the drum 200 may also be fixed at a certain level. Accordingly, even when the vibration occurs in the drum 200, the vibration may be buffered by at least one of the front casing 410 and the rear casing 420, or by the stopper 500.

However, when the vibration generated in the drum 200 is transmitted to the motor 600, even when the decelerator 700 and the motor 600 are fixed to the rear casing 420, vibration amplitudes of the motor 600 and the rear casing 420 may be greater than a vibration amplitude of the rotation shaft 740. Even at this time, there may be a problem that the driving shaft 630 and the rotation shaft 740 are not able to be remained coaxial with each other.

In order to solve such problem, the laundry treating apparatus according to the present disclosure may fix the motor 600 by coupling the motor 600 to the decelerator 700. In other words, the decelerator 700 itself may serve as a reference point for an entirety of the driver M. That is, the decelerator 700 may serve as a reference for the vibration of the entirety of the driver M and the amount of tilting angle.

Because the motor 600 is fixed only to the decelerator 700 rather than to another component of the laundry treating apparatus, when the vibration is transmitted to the driver M or the external force is transmitted, the motor 600 may always tilt or vibrate simultaneously with the decelerator 700 when the decelerator 700 tilts or vibrates.

As a result, the decelerator 700 and the driver 600 may form one vibration system, and the decelerator 700 and the driver 600 may be maintained in a state of being fixed to each other without a relative movement.

The stator 610 of the driver 600 may be directly coupled to the decelerator 700 to be fixed. Accordingly, a position at which the driving shaft 630 is installed with respect to the decelerator 700 may not be changed. A center of the driving shaft 630 and a center of the decelerator 700 may be arranged to coincide with each other, and the driving shaft 630 may rotate while being remained coaxial with the center of the decelerator 700.

The above-mentioned terms "coaxial" and "coincide" do not imply physically perfect coaxial and coincident states, but are a concept accepting an error range that may be accepted in terms of mechanical engineering or a range of a level that a person skilled in the art may accept as coaxial or coincident. For example, a range in which the driving shaft 630 and the rotation shaft 740 are misaligned with each other by equal to or less than 5 degrees may be defined as the coaxial or coincident state.

Because the driving shaft 630 rotates with respect to the decelerator 700, but is fixed to prevent the tilting, and the stator 610 is also fixed to the decelerator 700, a distance between the stator 610 and the rotor 620 may be always maintained. As a result, a collision of the stator 610 and the rotor 620 may be prevented, and noise or vibration that may occur as the rotor 620 rotates with respect to the stator 610 and a rotation center thereof changes may be fundamentally blocked.

The rotation shaft 740 may be provided to extend inside the decelerator 700 toward the drum 200, may vibrate together with the decelerator 700 and may tilt together with the decelerator 700. That is, the rotation shaft 740 may only be provided to rotate in the decelerator 700, and an installation position thereof may be fixed. As a result, the rotation shaft 740 and the driving shaft 630 may always be arranged in parallel with each other and may be coaxial with each other. In other words, the center of the rotation shaft 740 and the center of the driving shaft 630 may be maintained to coincide with each other.

The decelerator 700 and the motor 600 may be designed to be disposed along a first axis S1 parallel to the ground when there is no load on the drum 200 or the motor 600 does not operate. The driving shaft 630 and the rotation shaft 740 may also be disposed in parallel along the first axis S1.

However, when the vibration occurs in the drum 200 or the vibration occurs in the motor 600, the vibration is transmitted to the decelerator 700 and the decelerator 700 vibrates or tilts, so that the decelerator 700 may be temporarily in a state tilted toward a second axis S2

In this connection, because the motor 600 is in a state of being coupled to the decelerator 700, the motor 600 may vibrate or tilt together with the decelerator 700 to be disposed in parallel with the second axis S2. Accordingly, the driving shaft 630 and the rotation shaft 740 may also be disposed in parallel along the second axis S2.

As a result, even when the decelerator 700 tilts, the motor 600 may move integrally with the decelerator 700, and the driving shaft 630 and the rotation shaft 740 may be remained coaxial with each other.

Accordingly, because the driving shaft 630 and the rotation shaft 740 are always tilted with respect to the decelerator 700, the decelerator 700 may serve as an action point P1 of a lever or a seesaw. That is, the decelerator 700 may serve as the first action point P1 of the vibration system including the motor 600. In one example, the decelerator 700 is coupled to the drum 200 through the rotation shaft 740, and the drum 200 is spaced apart from the rear casing 420, so that the load of the drum 200 may be transmitted to the decelerator 700. A system including the drum 200 as well as the motor 600 may form one vibration system, and the decelerator 700 may serve as a reference or the action point p1 of the vibration system.

The decelerator 700 must be fixed or supported inside the cabinet 100 even though the decelerator 700 itself serves as the center or the action point P1 of the vibration system.

To this end, the decelerator 700 may be fixedly coupled to the rear casing 420. In this case, because the decelerator 700 will tilt or vibrate in the state coupled to the rear casing 420, it may be seen that the rear casing 420 serves as the center of the vibration system including the decelerator 700, the motor 600, and the drum 200. Even in this case, the motor 600 may be coupled to and fixed only to the decelerator 700 without being directly coupled to the rear casing 420 even though the motor 600 is able to be in contact with the rear casing 420.

Specifically, the mounting portion 429 of the rear casing 420 may serve as a second action point P2 of the lever or the seesaw formed by the decelerator 700, the motor 600, and the drum 200.

The decelerator 700, the motor 600, and the drum 200 may become in parallel with a third axis S3 after being disposed in parallel along the first axis 51. The third axis S3 may pass through the decelerator 700 coupled to the rear casing 420. In this connection, because the decelerator 700 and the motor 600 are coupled to each other, the motor 600 may also be disposed in parallel with the third axis S3.

As a result, the driver 600 and the drum 200 are coupled to the decelerator 700, so that the driver 600 and the drum 200 may tilt in parallel with each other or vibrate at the same time with respect to the decelerator 700.

The drum 200 of the laundry treating apparatus according to the present disclosure is supported by the decelerator 700 without being coupled to the belt. Accordingly, when the drum 200 is rotated by the decelerator 700, the drum 200 may be lifted upward or tilted downward by centrifugal force or the like.

To prevent this, the laundry treating apparatus according to the present disclosure may further include the stopper 500 for fixing the position of the drum 200. The stopper 500 may include a front stopper 510 disposed in front of the drum 200 and a rear stopper 520 disposed at the rear of the drum.

In this connection, the drum 200 may be lifted upward with respect to the rotation shaft 740. Accordingly, the front stopper 510 may be disposed so as to be in contact with an upper front portion of the drum.

In addition, the drum 200 may sag downward by the weight of the laundry. Accordingly, the rear stopper 520 may be disposed so as to be in contact with a lower rear portion of the drum 200.

The front stopper 510 may be coupled to the installation portion 416 of the front casing 410, and the rear stopper 520 may be supported on an upper portion of the heat exchanger 950.

Figure 7:
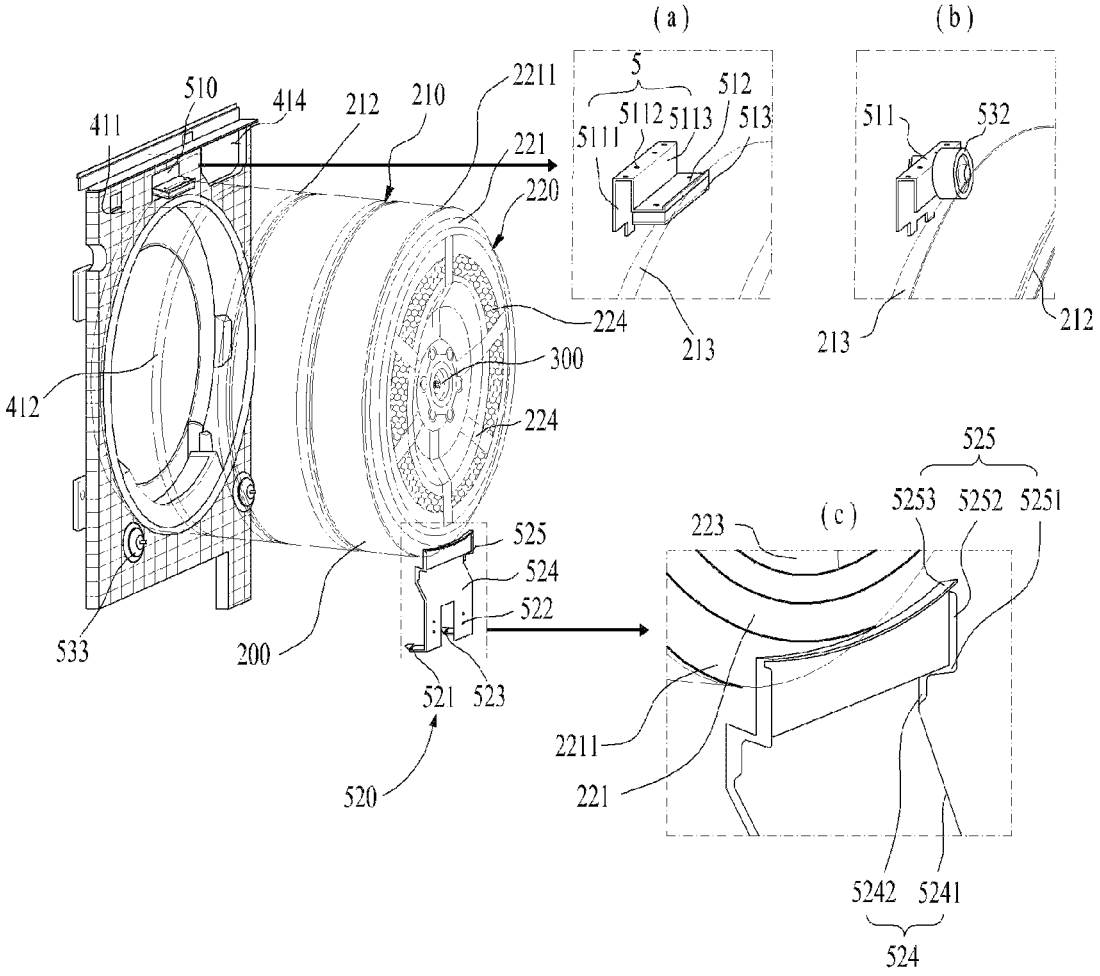
FIG. 7 shows a structure of supporting a drum of a laundry treating apparatus according to the present disclosure.

FIG. 7 shows the stopper 500 supporting the drum 200 of the laundry treating apparatus according to the present disclosure.

The drum 200 is coupled to a free end of the rotation shaft 740 and rotates. The rotation shaft 740 may be fixed to the decelerator 700 so as to be prevented from being misaligned with the decelerator 700.

However, the drum 200 may be misaligned upward or downward because of the load of the laundry or fall of the laundry occurring during the rotation. As a result, the drum 200 may be misaligned upward or downward with respect to the free end of the rotation shaft 740.

In particular, the drum 200 may vibrate or tilt independently of the free end of the rotation shaft 740. That is, the drum 200 may be made of a material having an elastic force, so that a certain level of deformation thereof may be allowed. This is to prevent excessive vibration or external force from being transmitted to the rotation shaft 740 to prevent the rotation shaft 740 and the driving shaft 630 from being misaligned with each other.

In addition, because the drum 200 is not fixed by the belt or the like, excessive vibration energy may occur when the drum 200 rotates in a state of accommodating the laundry therein.

In one example, the front casing 410 and the rear casing 420 are respectively disposed in front of and at the rear of the drum 200. The front casing 410 may avoid direct contact with the front surface of the drum 200 through the inlet communication hole 412 and the gasket 413. However, because the rear surface of the drum 200 is directly coupled to the rotation shaft 740, the rear portion of the drum body 210 is shielded by the drum rear surface 220, and the mounting portion 429 that should fix the driver M must be installed at a portion of the rear casing 420 directly facing the drum rear surface 220. In other words, the rear casing 420 is not able to have a surface facing the drum defined as a through-hole like the front casing 410.

Accordingly, when the rear casing 420 rotatably supports the rear portion or the rear surface of the drum 200 like the front casing 410, there is a risk of direct friction and collision of the drum rear surface 220 and the rear casing 420.

Specifically, the rear casing 420 has a lot of parts that interfere with the drum rear surface 220 because of a drum accommodating groove 422 to be described later, an air flow hole 423, and the mounting portion 429. In such situation, when the rear casing 420 directly supports the drum 200, the drum rear surface 220 and the rear casing 420 may be worn or damaged.

Therefore, the rear casing 420 needs to be maintained spaced apart from the drum 200 by a certain distance, and it may be impossible for the rear casing 420 itself to directly support the drum 200.

In addition, when the drum 200 rotates while accommodating the large amount of laundry therein, the drum 200 may rotate while moving in a direction of the front casing 410 or the rear casing 420 because there is no belt or the like.

Considering this comprehensively, the laundry treating apparatus of the present disclosure may further include the stopper 500 to limit the movement of the drum 200 within an allowed range.

The stopper 500 may include the front stopper 510 coupled to the front casing 410 to support a front upper end of the drum, a support wheel 533 that is rotatably disposed on the front casing 410 to support a front lower end of the drum, and a rear stopper 520 coupled to the rear casing 420 to support a rear lower end of the drum.

The drum 200 may be rotated by being supported by the driver M and the support wheel 533, and the front stopper 510 and the rear stopper 520 may be provided to limit the drum 200 only when the drum 200 moves excessively. Therefore, the front stopper 510 and the rear stopper 520 may buffer the vibration or temporarily occurred impact of the drum 200, and it may be possible to prevent the front stopper 510 and the rear stopper 520 from rather damaging the drum 200.

Referring to (a) in FIG. 7, the front stopper 510 may include a fixed plate 5111 coupled to the stopper installation portion 416 of the front casing 410, a lever plate 5112 extending rearward from the fixed plate 5111, an extension plate 5113 extending downward from the lever plate 5112, a support plate 512 extended from the extension plate 5113 and disposed at the front upper end of the drum 200, and a felt 513 coupled to a lower portion of the support plate 512 and in contact with the drum 200.

Accordingly, the front stopper 510 may absorb the impact of the drum 200 while the lever plate 5112 and the extension plate 5113 are lifted upward at a certain level when the drum 200 is lifted upward, and the felt 513 may rub against the front portion of the drum 200 to limit the drum 200 from being excessively lifted upward.

An outer circumferential surface of the laundry inlet 211 of the drum 200 may include a contact portion 213 having a diameter smaller than that of the drum body 210 to be in contact with the support wheel 533 or the felt 513. Accordingly, the felt 513 and the support wheel 533 are accurately seated on the contact portion 213 to limit the movement of the drum 200.

The front stopper 510 may be disposed to be spaced apart from the front upper end of the drum by a specific distance. The specific distance may correspond to a distance at which the drum 200 may deviate from the gasket 413 when rotating, or a range at which the drum 200 may excessively distort the rotation shaft 740.

Referring to (b) in FIG. 7, in the front stopper 510, the support plate 512 and the felt 513 may be formed as a contact wheel 532 rotatably contact the contact portion 213.

Accordingly, the support wheel 533 may support a lower portion of the contact portion 213 and the contact wheel may support an upper portion of the contact portion 213 to prevent the drum 200 from deviating the inlet communication hole 412.

Referring to (c) in FIG. 7, thus, the rear casing 420 and the drum 200 may be disposed to be spaced apart from each other, the rear stopper 520 and the driver M may support the rear portion of the drum 200, and when the drum 200 approaches the rear casing 420 excessively, the rear stopper 520 may block the excessive approach of the drum 200. As a result, it is possible to prevent damage resulted from friction or contact between the rear casing 420 and the drum 200.

The rear stopper 520 may be disposed in front of the rear casing 420 to prevent the drum rear surface 220 from coming into contact with and colliding with the rear casing 420. When the drum 200 rotates while accommodating the laundry therein, because the drum 200 is not fixed with the belt, the drum 200 not only moves upward or downward, but also generates an external force for moving forward or rearward.

Because the rear casing 420 supports the load of the driver M, the rear casing 420 must be made of a material having a thickness greater than that of the front casing 410 or having a rigidity greater than that of the front casing 410. Accordingly, because the rear casing 420 supports the drum 200 without buffering the movement of the drum 200 when the drum 200 moves downward, the rear casing 420 may generate a repulsive force of pushing the drum 200 upward.

In this process, the drum 200 may be strongly pressed toward the front casing 410, and in severe cases, the door 130 may be forcibly opened.

Accordingly, the rear stopper 520 may be spaced apart from the rear surface of the drum 200 by a reference distance to allow the drum 200 to move rearward at a certain level. Accordingly, it is possible to block the drum 200 from excessively pressing the front casing 410.

The reference distance may be defined as a distance at which the rear surface of the drum 200 and the rear stopper 520 may come into contact with and be supported by each other when the drum 200 is pushed rearward while rotating as the laundry of an amount equal to or greater than a reference cloth amount is accommodated in the drum 200.

Accordingly, the rear stopper 520 supports the drum 200 only when the drum 200 moves rearward by the reference distance, thereby preventing the rear stopper 520 from being worn. A felt that may be in contact with the drum 200 may be attached to the rear stopper 520.

In addition, the drum 200 and the rear casing 420 may be disposed to be spaced apart from each other by a distance equal to or greater than the reference distance.

The rear stopper 520 may include a support coupling portion 521 supported on the bottom surface of the cabinet 100 or the hot air supplier 900, a support leg 522 extending from the support coupling portion 521 toward the drum 200, an extension 524 obliquely extending frontward from the support leg 522, and a limiting portion 525 extending from the extension portion 524 to face the drum rear surface 220.

The support leg 522 may further have a cut-out groove 523 defined therein to enhance rigidity.

The extension 524 extends obliquely from the support leg 522 to strengthen rigidity of an entirety of the rear stopper 520 while buffering the external force applied from the drum 200 at a certain level.

The extension 524 may include an inclined extension 5241 extending frontward from the support leg 522, and a straight extension 5242 extending upward from the inclined extension 5241.

The limiting portion 525 may include a spacer 5251 extending rearward from the straight extension 5242 and spaced apart from the drum rear surface 220, and a load support 5252 extended from the spacer 5251 and disposed to face the lower portion of the drum rear surface 220.

In order to reinforce rigidity of the load support 5252, a curved portion 5253 provided by bending a free end of the load support 5252 may be further installed.

The rear stopper 520 may be blocked from directly contacting the rear surface of the drum 200 by the spacer 5251. Rather, it may allow the drum 200 to move rearward at the certain level.

Consequently, the rear casing 420 may be disposed between the rear stopper 520 and the decelerator 700 or the driver 600.

In one example, the rear stopper 520 may be disposed to be spaced apart from the lower portion of the drum by a certain distance. The certain distance may correspond to a distance at which the drum 200 deviates from a sealing portion 450 or a distance at which the drum 200 excessively distorts the rotation shaft 740.

That is, the straight extension 5242 may be disposed to be spaced apart from the rear surface of the drum 200 by the certain distance.

Figure 8:
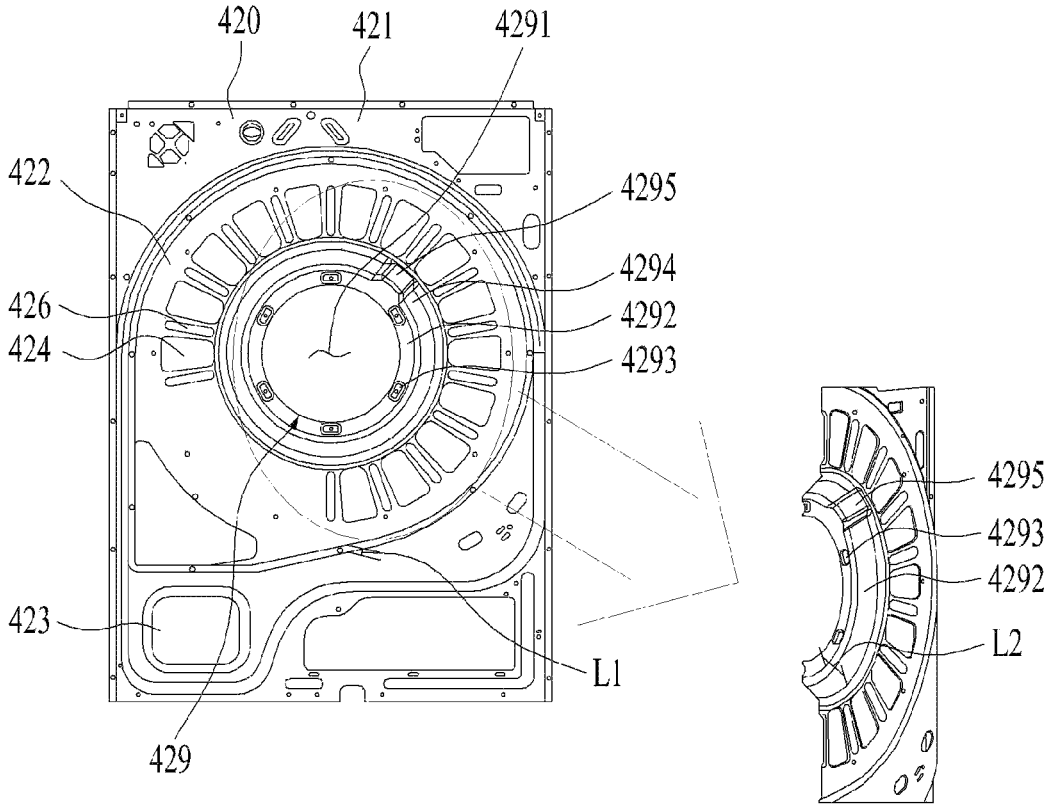
FIG. 8 shows a structure of a rear casing of a laundry treating apparatus according to the present disclosure.

FIG. 8 shows a structure of the rear casing 420 of the present disclosure rear casing.

The motor 600 is coupled to and fixed to the decelerator 700, so that, even when the decelerator 700 itself serves as a reference for the position and the vibration of the driver M, the decelerator 700 needs to be supported while being disposed on the rear surface of the drum 200 in order to rotate the drum 200.

Accordingly, the decelerator 700 may be seated on the rear casing 420 and supported inside the cabinet 100. However, the motor 600 and the drum 200 may be disposed to be spaced apart from the rear casing 420. This is to prevent the motor 600 or the drum 200 from interfering with components other than the decelerator 700 and moving independently of the decelerator 700.

As a result, the rear casing 420 may serve as an action point of a seesaw in a vibration system or a rotation system including the decelerator 700, the motor 600, and the drum 200.

The rear casing 420 may include the rear plate 421 disposed on the rear surface of the drum 200 and disposed to face the front plate 411, and the drum accommodating groove 422 protruding from the rear plate 421 to have a shape corresponding to that of the drum rear surface 220. The drum accommodating groove 422 may be spaced apart from the drum rear surface 220, but may protrude from the rear plate 421 to have a diameter and a depth for partially accommodating the outer circumferential surface of the drum rear surface 220. That is, the drum accommodating groove 422 may protrude from the rear plate 421 by a first height L1 to induce the drum rear surface 220 to be partially accommodated in a front portion of the rear plate 421. A plurality of communication holes 424 that face the suction holes 224 of the drum rear surface 220 and allows air to pass therethrough may be defined in the drum accommodating groove 422. Each reinforcing bent portion 426 capable of reinforcing rigidity may be disposed between two adjacent communication holes 424. Each reinforcing bent portion 426 is provided to be recessed or protruded between the two adjacent communication holes 424 to prevent rigidity of a portion of the rear plate 421 between the two adjacent communication holes 424 from being weakened. The plurality of communication holes 424 are components that allow the hot air supplied from the hot air supplier 900 to be supplied to the drum 200. In this connection, because the drum accommodating groove 422 accommodates the drum rear surface 220 therein, the hot air discharged from the communication holes 424 may be induced to be supplied to the suction holes 224. In one example, the laundry treating apparatus according to the present disclosure may further include a sealing portion 450 disposed to seal a space between the drum accommodating groove 422 and the drum rear surface 220, and the sealing portion 450 may be accommodated and mounted in the drum accommodating groove 422.

As a result, the drum accommodating groove 422 may provide a space in which the sealing portion 450 may be installed as well as reinforce the rigidity of the rear plate 421.

The mounting portion 490 may be provided by being recessed into the drum accommodating groove 422 in a direction opposite to a direction in which the drum accommodating groove 422 protrudes. The mounting portion 490 may be provided by being recessed by a depth L2 from an inner circumferential surface of the drum accommodating groove 422. The mounting portion 490 is provided by being recessed into the drum accommodating groove 422, so that the rigidity of the drum accommodating groove 422 may also be strengthened, and at the same time, an overall rigidity of the rear plate 421 may be strengthened.

In addition, the mounting portion 490 may be disposed closer to the drum rear surface 220 by being recessed frontward by L2 into the drum accommodating groove 422. Accordingly, a distance between the decelerator 700 mounted and fixed to the mounting portion 490 and the drum rear surface 220 may be reduced, and a length of the rotation shaft 740 connecting the decelerator 700 to the drum rear surface 220 is further reduced by that much, thereby not only guaranteeing durability of the rotation shaft 740, but also reducing an angular range in which the rotation shaft 740 may be distorted.

In addition, the mounting portion 490 may be recessed into the drum accommodating groove 422, but may be have a diameter larger than diameters of the decelerator 700 and the driver 600. Accordingly, at least a portion of the decelerator 700 and the motor 600 may be accommodated in the mounting portion 490 to reduce an overall thickness of the cabinet 100.

The mounting portion 490 may include a shaft through-hole 4291 through which the rotation shaft 740 extending from the decelerator 700 through the rear plate 421 passes, a mounting surface 4292 disposed on an outer circumferential surface of the shaft through-hole 4291 to support the decelerator 700, and a mounting groove 4294 extending rearward from the mounting surface 4292 toward the drum accommodating groove. A fastening portion 4293 coupled to the decelerator 700 or a coupling portion 800 for coupling the decelerator 700 to the mounting surface 4292 may be installed on the mounting surface 4292.

In one example, at least a portion of the decelerator 700 or the motor 600 may be accommodated in the mounting groove 4294. Accordingly, an electric wire support groove 4295 in which an electric wire supplying current to the stator 610 may be seated may be defined by being recessed outwardly from the mounting groove 4294. The mounting groove 4294 may have a diameter larger than the diameter of the driver M.

In one example, the rear casing 420 may further include the air flow hole 423 for transferring the hot air supplied from the connector 930 to the duct cover 430. The air introduced into the air flow hole 423 may be introduced into the communication hole 424 along the duct cover 430.

Figure 9:
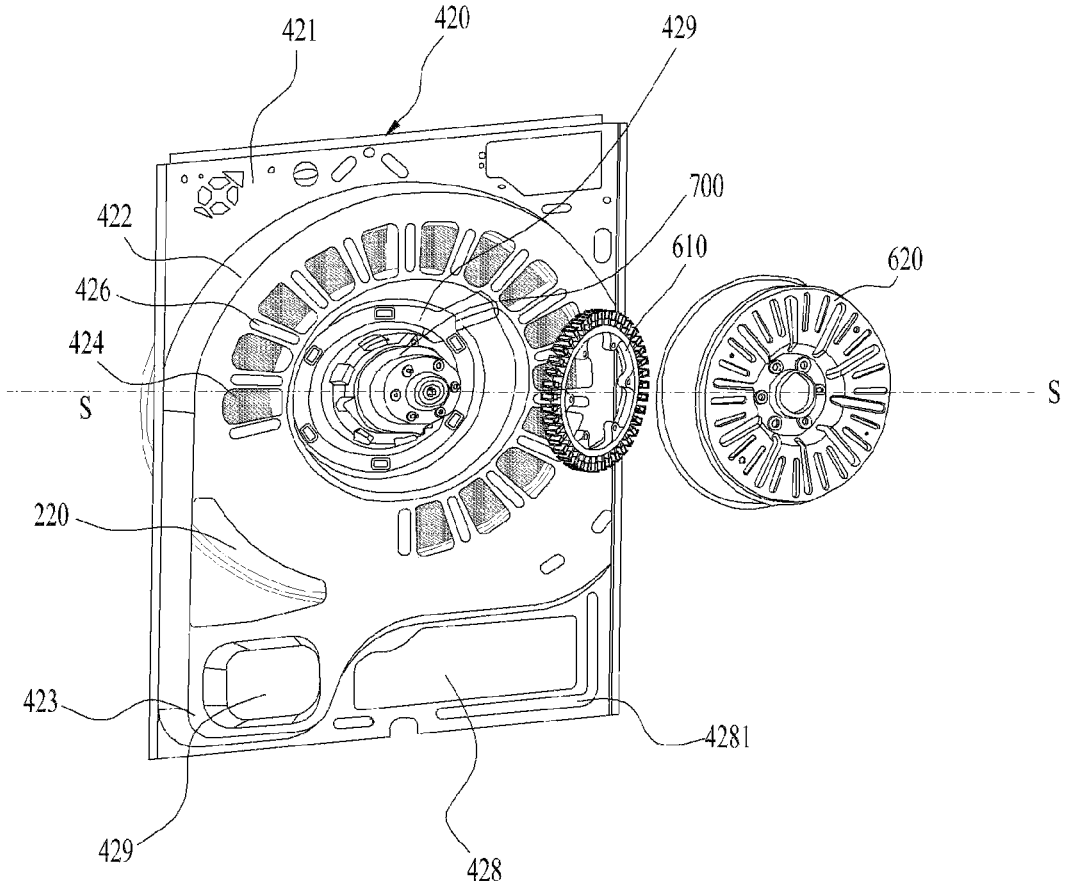
FIG. 9 shows a structure in which a driver is coupled to the rear casing.

FIG. 9 shows that the motor 600 of the laundry treating apparatus according to the present disclosure is coupled to the decelerator 700.

The decelerator 700 may be mounted and supported on the mounting portion 429 to rotate the drum 200. The stator 610 may be directly coupled to and fixed to the decelerator 700, and may be spaced apart from the mounting portion 429. The rotor 620 may be supported by the decelerator 700 by the driving shaft 630 coupled to the decelerator 700, and may be provided to rotate with respect to the stator 610.

As the stator 610 is coupled to the decelerator 700, the decelerator 700 and the motor 600 may be disposed in parallel with each other to be disposed along the same axis S. The motor 600 may have a rotation center disposed on the same axis S, and the decelerator 700 may also have a rotation center disposed on the same axis S.

As a result, the rotor 620 may also rotate with respect to the same axis S, and the rotation shaft 740 extending from the decelerator 700 may also rotate with respect to the same axis S.

The decelerator 700 may be directly coupled to fix the stator 610. The stator 610 may be disposed to be spaced apart from the rear casing 420, and may be disposed to be spaced apart from the mounting portion 429.

In one example, the stator 610 may be supported by being in contact with the rear casing 420, and may be additionally coupled to the rear casing 420 when the stator 610 is directly fixed to the decelerator 700.

Because the stator 610 is coupled to the decelerator 700, and the decelerator 700 converts the rpm of the driving shaft 630 to rotate the rotation shaft 740, the drum 200 may also rotate with respect to the same axis S.

Even when the decelerator 700 vibrates or rotates and the same axis S is misaligned, the driving shaft 630 and the rotation shaft 740 may be disposed in parallel with the same axis S.

As a result, the decelerator 700 may be coupled to and fixed to the rear casing 420.

Because the decelerator 700 is coupled to a rear portion of the rear casing 420 and the drum 200 is disposed in front of the rear casing 420, the rear casing 420 may be disposed between the drum 200 and the decelerator 700.

The decelerator 700 may rotate the drum as the drum rotation shaft 740 passes through the rear casing 420, and may support the load of the drum through the drum rotation shaft 740.

In addition, it may be seen that the rear casing 420 is disposed between the drum 200 and the motor 600. The decelerator 700 may be disposed between the drum 200 and the motor 600 to be supported by the rear casing 420.

In this connection, both the drum 200 and the motor 600 may be completely spaced apart from the rear casing 420. Accordingly, the decelerator 700 may serve as a support center of the drum 200 and the motor 600.

In addition, it may be seen that the drum 200 is disposed in front of and spaced apart from the rear casing 420, the motor is disposed at the rear of and spaced apart from the rear casing 420, and the decelerator 700 is coupled to the rear casing from the rear by passing through the rear casing to connect the motor 600 and the drum 200 to each other.

Accordingly, the drum 200 and the motor 600 may be provided to transmit at least a portion of the load to the rear casing 420 through the decelerator 700.

As a result, the motor 600, the decelerator 700, and the drum 200 may simultaneously tilt with respect to the rear casing 420 or may simultaneously vibrate.

In addition, because the stator 610 is fixed to the decelerator 700, the driving shaft 630 may be tilted together with the decelerator 700 or vibrate simultaneously with the decelerator 700.

Figure 10:
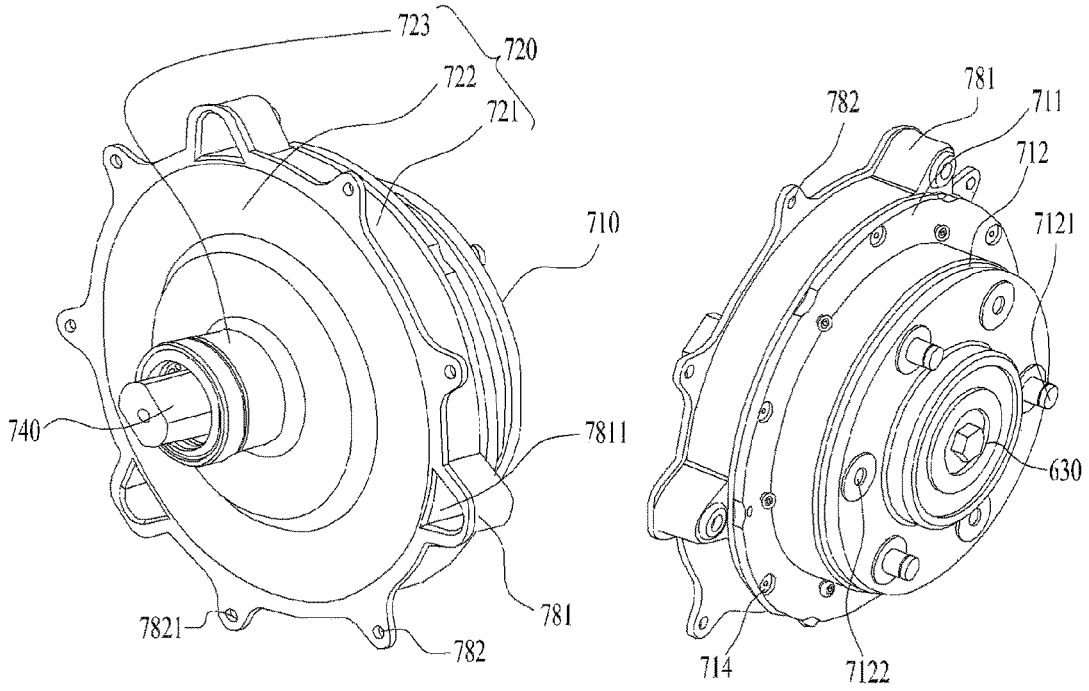
FIG. 10 shows a decelerator of a laundry treating apparatus according to the present disclosure.

FIG. 10 shows an appearance of the decelerator 700.

The decelerator 700 may include a decelerator housing 710 and 720 that form the appearance of the decelerator 700 and accommodates a gearbox therein. The decelerator housing may include a first housing 710 facing the motor 600, and a second housing 720 facing the drum 200.

Referring to (a) in FIG. 10, most of the gearbox inside the decelerator 700 may be accommodated in the first housing 710, and the second housing 720 may be provided to shield an interior of the decelerator 700. Accordingly, the length of the drum 200 may be further extended by reducing an overall thickness of the decelerator 700.

The second housing 720 may include a blocking body 722 provided to shield the first housing 710, a coupling body 721 extending along a circumference of the blocking body 722 and coupled to the first housing 710, and a shaft support 723 provided to support the rotation shaft 740 in the blocking body 722.

The blocking body 722 may be formed in a disk shape, and the coupling body 721 may extend toward a portion of the first housing 710 from the blocking body 722 while having a certain thickness.

In one example, the coupling body 721 may be disposed in the first housing 710 to couple the blocking body 722.

The shaft support 723 may prevent the rotation shaft 740 from being misaligned to maintain alignment between the rotation shaft 740 and the driving shaft 630.

A fastening portion 780 having a certain thickness to fix the decelerator 700 to the stator 610 or the mounting portion 429 may be installed on the coupling body 721.

The fastening portion 780 may protrude outward from the coupling body 721, and may be integrally formed with the coupling body 721. The fastening portion 780 may include at least one of a fastening protrusion 781 that may be coupled to the stator 610 and a coupling protrusion 782 that may be coupled to the mounting portion 429. The coupling protrusion 782 may include a plurality of coupling protrusions spaced apart from each other along an outer circumferential surface of the coupling body 721, and the plurality of coupling protrusions may be disposed to be spaced apart from each other at the same angle with respect to a shaft accommodating portion 713.

Referring to (b) in FIG. 10, the first housing 710 is formed in a multi-step shape to accommodate gears of various diameters. In general, the gearbox coupled to the decelerator 700 may include a sun gear, a planetary gear orbiting the sun gear, and a ring gear accommodating the planetary gear therein to induce the planetary gear to rotate. The first housing 710 may include a ring gear housing 711 coupled to the second housing 720 and accommodating the ring gear therein, and a planetary gear housing 712 extending from the ring gear housing 711 to be away from the second housing 720 to accommodate one end of the planetary gear therein.

The planetary gear housing 712 may have a smaller diameter than the ring gear housing 711. However, a center of the planetary gear housing 712 and a center of the ring gear housing 711 may be designed to be disposed on the same axis S.

The driving shaft 630 rotatably coupled to the rotor 620 may be coupled to the planetary gear housing 712. The driving shaft 630 may be inserted into the first housing 710 and rotatably supported by the gearbox inside the first housing 710.

A washer 640 for rotatably supporting the rotor 620 may be seated on one surface of the planetary gear housing 712, and a washer protrusion 7121 to which the washer 640 is coupled and fixed may be installed. In addition, the planetary gear housing 712 may also include a washer coupling hole 7122 defined therein to which the washer 640 may be rotatably coupled.

The washer protrusion 7121 and the washer coupling hole 7122 may include a plurality of the washer protrusions and a plurality of washer coupling holes disposed to be spaced apart from each other at a certain angle with respect to the driving shaft 630, respectively.

The fastening protrusion 781 may have a larger cross-sectional area and a greater thickness than the coupling protrusion 782. Accordingly, a coupling force between the fastening protrusion 781 and the stator 610 may be strengthened, and the vibration transmitted from the stator 610 may be more easily tolerated.

The stator 610 may be seated on the fastening protrusion 781 and coupled to the fastening protrusion 781 with a separate fixing member. The fastening protrusion may have a fastening protrusion hole 7811 defined therein to which a fixing member fastened through the stator 610 may be fastened, and the fastening protrusion hole 7811 may have a thread formed therein that may be coupled to the fixing member.

Figure 11:
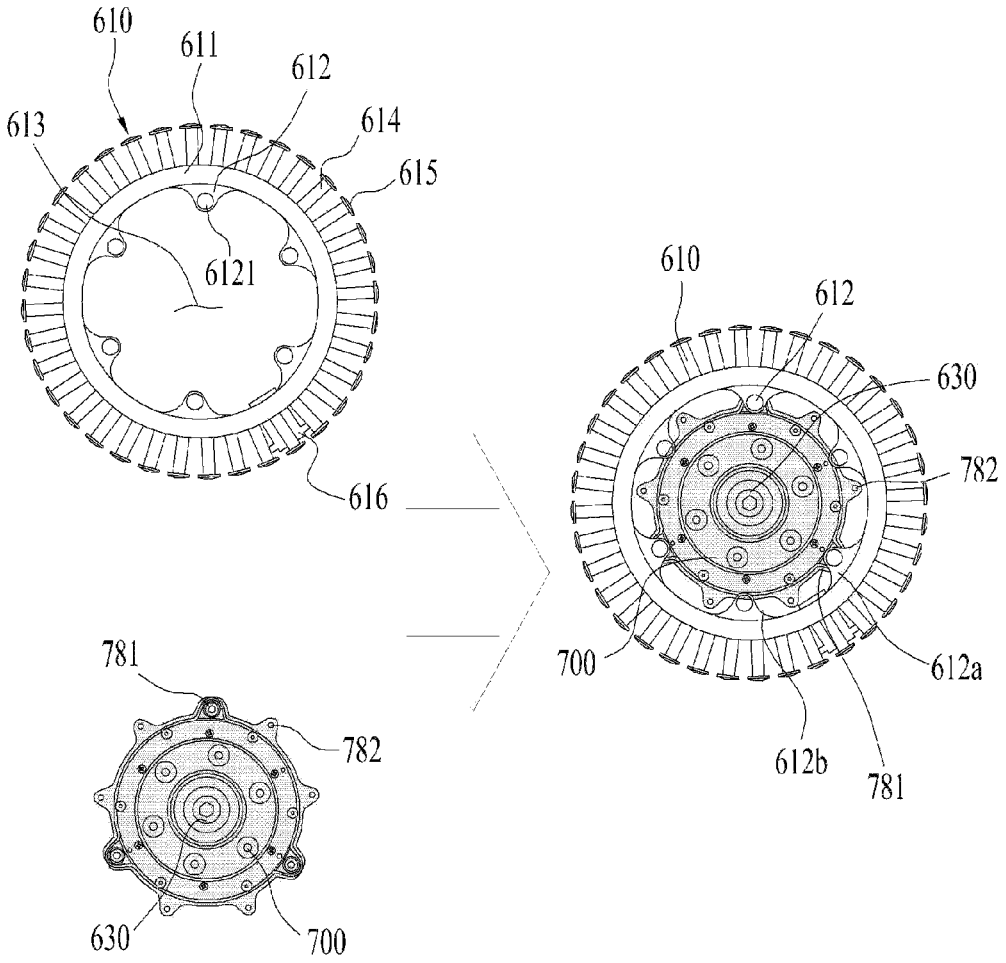
FIG. 11 shows a coupling structure of a decelerator and a stator of a laundry treating apparatus according to the present disclosure.

FIG. 11 shows a structure in which the stator 610 is coupled to the decelerator 700.

The stator 610 may include a main body 611 fixed to the decelerator 700 and formed in a ring shape, a fixing rib 612 extending from an inner circumferential surface of the main body 611 and coupled to the fastening protrusion 781, teeth 614 extending from an outer circumferential surface of the main body 611 along a circumference of the main body 611 and to which coils are wound, a pole shoe 615 disposed at a free end of the tooth 614 to prevent the coil from deviating, and a terminal 616 that controls supply of current to the coil.

The main body 611 may have an accommodating space 613 therein, the fixing rib 612 may include a plurality of fixing ribs disposed inside the main body 611 and spaced apart from each other at a certain angle with respect to the accommodating space 613, and a fixing rib hole 6121 into which a fixing member coupled to the fastening protrusion 781 is installed may be defined inwardly of the fixing rib 612.

Because the stator 610 is directly coupled to the decelerator 700, the decelerator 700 may be coupled to the stator 610 by being at least partially accommodated in the stator 610.

In particular, when the decelerator 700 is accommodated in the stator 610, a thickness of an entirety of the driver M may be reduced to further expand a volume of the drum 200. In addition, when the decelerator 700 is accommodated in the stator 610, the rotation shaft 740 of the decelerator 700 and the driving shaft 630 may be more precisely maintained coaxial with each other.

To this end, the decelerator 700 may have a diameter smaller than a diameter of the main body 611. That is, the largest diameter of the first housing 710 and the second housing 720 may be smaller than the diameter of the main body 611. Accordingly, at least a portion of the decelerator 700 may be accommodated and disposed in the main body 611. However, the fastening protrusion 781 may be extended to overlap the fixing rib 612 in the decelerator housing. Accordingly, the fastening protrusion 781 may be coupled to the fixing rib 612, and portions of the first housing 710 and the second housing 720 may be located inside the main body 611.

The fixing rib 612 may include a first fixing rib 612*a* directly coupled to the fastening protrusion 781, and a second fixing rib 612*b* that is not directly coupled to the fastening protrusion 781 but is able to support the fastening protrusion 781 or the first housing 710.

The coupling protrusion 782 may be disposed to be misaligned with the fastening protrusion 781 to prevent interference with the fastening protrusion 781.

Figure 12:
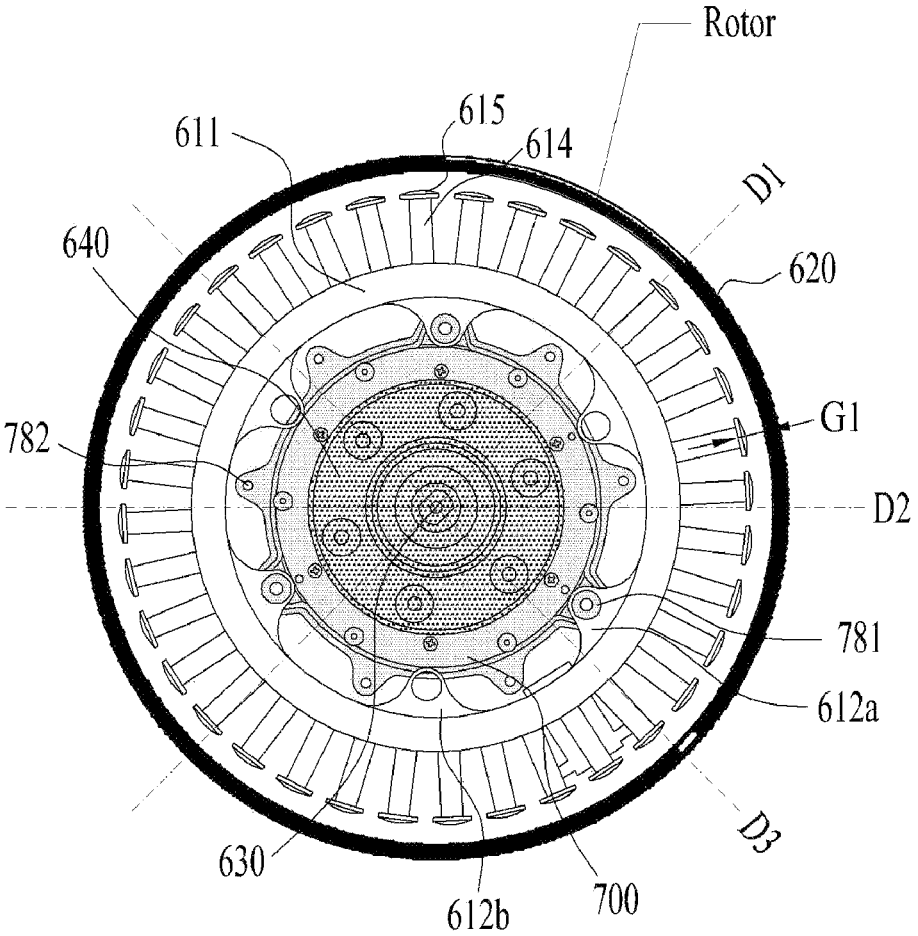
FIG. 12 shows a final coupling structure of a driver of a laundry treating apparatus according to the present disclosure.

FIG. 12 shows a structure in which the motor 600 is coupled to the decelerator 700.

The stator 610 is coupled to the decelerator 700. The stator 610 may be coupled to one surface of the decelerator 700, but may be coupled to the fastening protrusion 781 protruding outward from the housing of the decelerator 700, so that at least a portion of the decelerator housing may be accommodated inside the main body 611. Accordingly, a center of the main body 611, a center of the decelerator 700, and the rotation shaft 740 may always be coaxial with each other.

In one example, the rotor 620 may be disposed to accommodate the stator 610 while being spaced apart from the pole shoe 615 by a certain distance. Because the driving shaft 630 is fixed to the decelerator 700 accommodated in the main body 611, a gap G1 between the rotor 620 and the stator 610 may always be maintained.

Accordingly, the rotor 620 and the stator 610 may be prevented from colliding with each other or from rotating while being temporarily distorted in the stator 610, thereby preventing noise or unnecessary vibration from occurring.

In one example, all of a virtual first diameter line D1 passing through the center of the decelerator 700 and the center of the driving shaft 630, a virtual second diameter line D2 passing through the center of the main body 611, and a virtual third diameter line D3 passing through the center of the rotor 620 may be disposed at a rotation center of the driving shaft 630.

Accordingly, because the decelerator 700 itself becomes the rotation center of the driving shaft 630 and the stator 610 is directly fixed to the decelerator 700, the driving shaft 630 may be blocked from being misaligned with the decelerator 700. As a result, reliability of the decelerator 700 may be guaranteed.

Figure 13:
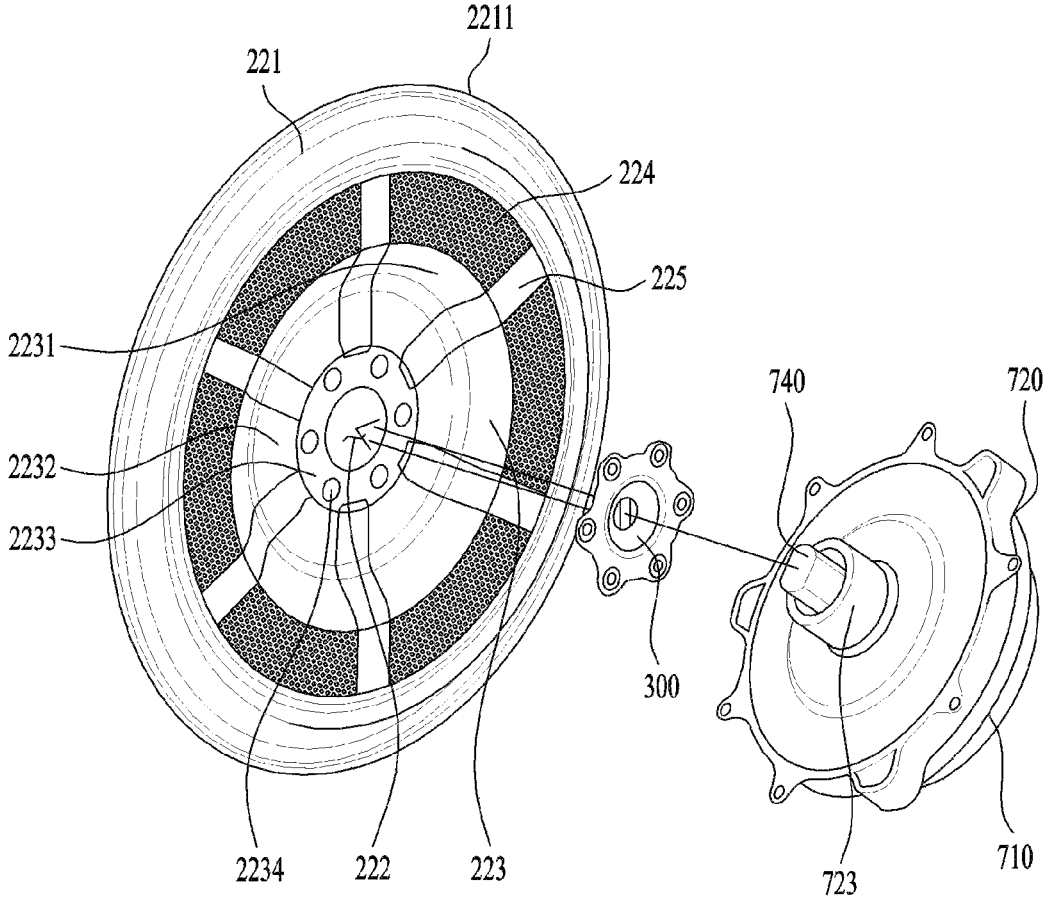
FIG. 13 shows a structure in which shafts of a drum and a driver of a laundry treating apparatus according to the present disclosure are coupled to each other.

FIG. 13 shows a structure in which the drum 200 is coupled to the driver M.

The drum 200 and the driver M are installed inside the cabinet 100. In this connection, in order to increase a drying capacity, it is necessary to increase at least one of the diameter and the length of the drum 200. Accordingly, the volume of the cabinet 100 is also increased.

In this connection, because a height and a length of the cabinet 100 are fixed or standardized, in order to expand the drying capacity inside the cabinet 100, it may be required to increase the length of the drum 200 as much as possible.

As the length T3 of the driver increases, the length T2 of the drum is reduced, and thus, the drying capacity of the drum is reduced, so that it is necessary to secure the length T2 of the drum as much as possible by reducing the length T3 of the driver (see FIG. 4).

In order for the rotation shaft to extend from the drum 200 and for the driver M to be coupled while supporting the rotation shaft protruding from the drum, the length of the driver M is increased in a direction of the rotation shaft to sufficiently support and accommodate the rotation shaft.

In addition, when the decelerator 700 is disposed as in the laundry treating apparatus according to the present disclosure, the decelerator 700 has no choice but to be elongated in the direction of the rotation shaft to accommodate and support the rotation shaft extended from the drum without the distortion of the rotation shaft. As the overall length T3 of the driver M increases, there is a risk that the length T2 of the drum 200 may be reduced.

In addition, the gearbox coupled to the driving shaft 630 exists in the decelerator 700, and the gearbox has a complex configuration. In such situation, because the rotation shaft extending from the drum 200 and the gearbox are not able to be manufactured integrally, a separate component for coupling the rotation shaft extended from the drum 200 to the gearbox should be added.

Accordingly, the volume of the decelerator 700 may be further increased, so that the length T2 of the drum 200 may be further reduced.

Moreover, in order for the rotation shaft to protrude from the drum rear surface 220 and extend, the spider extending towards the circumference of the drum rear surface 220 or the inner circumferential surface of the drum body 210 is necessary such that the rotation shaft may be fixed to the drum rear surface 220. When the spider is coupled to the drum rear surface 220, the overall length T2 of the drum may be reduced or the internal volume of the drum may be reduced by a thickness of the spider.

As a result, when the driver M accommodates the rotation shaft coming out of the drum and is coupled to the rotation in a male and female coupling, like the related art drum (driver: female, drum: male), the length T3 of the tip of the driver is unnecessarily increased at the outside of the drum rear surface 220, and the length T2 of the drum 200 is reduced that much.

Therefore, the laundry treating apparatus according to the present disclosure may be provided such that the rotation shaft 740 extends from the driver M and the drum 200 is coupled to the rotation shaft 740 to rotate. In other words, the rotation shaft 740 may protrude from the driver, and the drum 200 may be coupled to a free end of the rotation shaft 740 to rotate (driver: male, drum: female).

A center of the drum rear surface 220 may be coupled to the free end of the rotation shaft 740 extending from the decelerator 700 to receive a rotational force provided by the rotation shaft 740 to rotate the drum body 210.

From another point of view, because the drum 200 is rotatably supported by the stopper 500 such as the support wheel 533, the front casing, and the like, the drum 200 may rotate easily when the rotational force is merely applied to the drum 200. Accordingly, when the rotation shaft 740 extended from the decelerator 700 merely applies the rotational force to the drum 200, the drum 200 may easily rotate.

Furthermore, because the rotation shaft 740 is accommodated and supported in the decelerator 700, the drum rear surface 220 does not need the spider for supporting the rotation shaft 740 so as not to be distorted.

Therefore, the rotation shaft 740 supported in the decelerator 700 may be simply coupled to the drum rear surface 220 to rotate the drum 200.

The decelerator 700 may be directly coupled to the drum rear surface 220. However, the drum rear surface 220 needs to have a considerable thickness and rigidity in order to be firmly coupled to the rotation shaft 740. In this case, a weight of the drum 200 may be unnecessarily increased and more energy may be consumed when the decelerator 700 rotates the drum 200.

Accordingly, the bushing portion 300 disposed to be coupled to the rotation shaft 740 may be additionally coupled to the drum rear surface 220. That is, the bushing portion 300 may be made of a strong material or made to be thick to maintain the shape and rigidity thereof even when being coupled to the rotation shaft 740 and being changed in the rotation direction or rapidly accelerated and rotated. In addition, the drum rear surface 220 may be made of a material softer than that of the bushing portion 300 or may be thinner than the bushing portion 300.

As a result, the rotation shaft 740 extending from the decelerator 700 may be coupled to the bushing portion 300, and the bushing portion 300 may be coupled to the drum rear surface 220.

The drum rear surface 220 may include the circumferential portion 221 for shielding the rear portion of the drum body 210 and the seating portion 223 disposed inwardly of the circumferential portion 221 and to which the bushing portion 300 is coupled. The circumferential portion 221 may have the suction hole through which the hot air supplied from the hot air supplier 900 is introduced into the drum body 210, and an outer circumferential surface of the circumferential portion 221 may have a coupling bent portion 2211 that may be fixedly coupled to the rear surface of the drum body 210.

The seating portion 223 may be located at the center of the drum rear surface 220, and may have a diameter the same as or greater than the diameter of the bushing portion 300. The seating portion 223 may have a mounting hole 222 defined at a center thereof in which a portion of the bushing portion 300 coupled to the shaft may be accommodated.

The seating portion 223 may be recessed inwardly of the circumferential portion 221. The seating portion 223 may be recessed into the circumferential portion 221 to enhance the rigidity of the entirety of the drum rear surface 220, and even when receiving the rotational force as the bushing portion 300 is coupled thereto, may disperse the rotational force to maintain the shape of the drum rear surface 220.

The seating portion 223 has a diameter greater than the diameter of the decelerator 700 and than the diameter of the mounting portion 429, and is recessed frontward from the drum rear surface 220, so that at least a portion of the driver M may be accommodated.

Accordingly, by reducing the distance between the drum 200 and the driver M, the length of the rotation shaft 740 may be further reduced and the length T2 of the drum may be further increased.

The seating portion 223 may include an accommodating surface 2231 extending inwardly of the drum body 210 from the inner circumferential surface of the circumferential portion 221, and a support surface 2232 extending from the accommodating surface 2231 to face the driver M. An installation surface 2233 on which the bushing portion 300 may be seated and fixed may be disposed on an inner circumferential surface of the support surface 2232. The mounting hole 222 may be defined in an inner circumferential surface of the installation surface 2233, the installation surface 2233 may have a diameter equal to or larger than the diameter of the bushing portion 300, and a coupling groove 2234 coupled to the bushing portion 300 by a bolt or welding may be further defined.

The bushing portion 300 may be fixed to the installation surface 2233 and coupled to the drum rear surface 220, and may be coupled to the free end of the rotation shaft 740.

The bushing portion 300 may be coupled to the rotation shaft 740 by accommodating the free end of the rotation shaft 740 therein, or by partially accommodating the free end of the rotation shaft 740. Accordingly, the coupling force between the rotation shaft 740 and the bushing portion 300 may be strengthened.

In one example, the rotation shaft 740 may not be formed in a circular shape, but may be formed in an elliptical shape or in a track shape in which two sides facing each other are in a semicircle shape and the remaining two sides facing each other are in a straight shape. In addition, the bushing portion 300 may be provided such that a cross-section thereof is in surface-contact with the rotation shaft 740 formed in the elliptical and track shapes. Accordingly, it is possible to prevent the rotation shaft 740 from rotating in vain inside the bushing portion 300.

Figure 14:
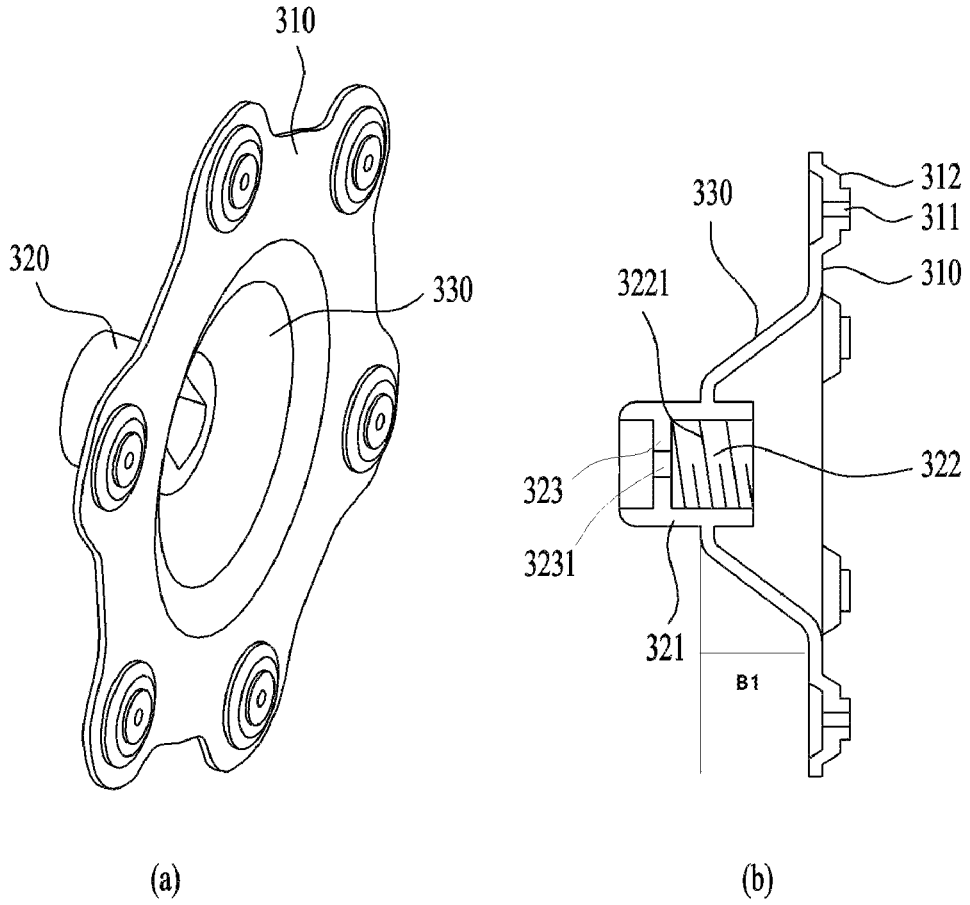
FIGS. 14A and 14B show a structure of a bushing of a laundry treating apparatus according to the present disclosure.

FIGS. 14A and 14B shows one embodiment of the bushing portion 300.

Referring to FIG. 14A, the bushing portion 300 may include a coupling surface 310 on which the coupling groove 2234 may be seated and fixed, and a shaft coupling portion 320 disposed inward of the coupling surface 310 and to which the rotation shaft 740 is coupled. The coupling surface 310 may be formed in a plate shape and may be supported as the coupling groove 2234 is seated thereon.

The bushing portion 300 may have a recessed surface 330 that is recessed inward of the inner circumferential surface of the coupling surface 310 to further accommodate the rotation shaft 740 therein, and the shaft coupling portion 320 may be located inside the recessed surface 330.

The shaft coupling portion 320 may be formed in a shape of a pipe capable of coupling the rotation shaft 740, and may be provided to extend frontward or rearward from the inner circumferential surface of the recessed surface 330.

The recessed surface 330 may be formed in a cylindrical cone shape to be inserted into the mounting hole 222, and may be in contact with and be supported by an inner circumferential surface of the mounting hole 222.

Referring to FIG. 14B, the coupling surface 310 may include a plurality of bushing coupling portions 312 disposed to extend radially with respect to the recessed surface 330 or the shaft coupling portion 320.

The bushing coupling portion 312 may further protrude outward from the coupling surface 310. A distance from the recessed surface 330 to an outer surface of the bushing coupling portion 312 may be greater than a distance from the recessed surface 330 to a portion of the coupling surface 310 where the bushing coupling portion 312 is not formed. The bushing coupling portion 312 may further expand an area of the coupling surface 310.

In addition, the bushing coupling portion 312 may further protrude from the coupling surface 310 in a thickness direction. That is, the bushing coupling portion 312 may be thicker than the coupling surface 310, or may be formed as the coupling surface 310 is pressed in the thickness direction.

The bushing coupling portion 312 may protrude from the coupling surface 310 in a direction opposite to the recessed surface 330.

The bushing coupling portions 312 may be fixed by being seated in the coupling groove 2234 of the seating portion 223, and may be welded to the coupling groove 2234 or fastened with the coupling groove 2234 using a fastening member such as the bolt.

The bushing coupling portion 312 may further include a coupling hole 311 to which the fastening member may be coupled by passing therethrough. The bushing coupling portion 312 may further protrude from the coupling surface 310 in the thickness direction or in an outward direction to effectively distribute an external force applied from the fastening member.

The bushing coupling portions 312 may be disposed to be spaced apart from each other by the same angle with respect to the recessed surface 330 or the shaft coupling portion 320. That is, when the number of bushing coupling portions 312 is n, the bushing coupling portions 312 may be spaced apart from each other by 360/n degrees. For example, when the number of bushing coupling portions 312 is 6, the bushing coupling portions 312 may be spaced apart from each other by 60 degrees.

In one example, the bushing coupling portion 312 may protrude from the coupling surface 310 in two steps. That is, the bushing coupling portion 312 may protrude from the coupling surface 310 with a relatively large diameter, and may further protrude from the protruded portion with a relatively small diameter. Accordingly, the bushing coupling portion 312 itself may effectively disperse the external force transmitted from the coupling member, and a surface area coupled to the coupling member may be increased.

In addition, the coupling groove 2234 defined in the seating portion 223 of the drum rear surface 220 is also formed in two steps in the same manner as the bushing coupling portion 312, so that a coupling area of the coupling groove 2234 and the bushing coupling portion 312 may be increased.

In addition, the bushing coupling portion 312 may be immediately seated and fixed in the coupling groove 2234, so that an installation position of the bushing portion 300 may be easily determined, and the process of coupling the coupling member may also be facilitated.

In one example, the shaft coupling portion 320 may include a coupling body 321 to which the rotation shaft 740 is coupled. The coupling body 321 may be formed in a pipe shape, so that the free end of the rotation shaft 740 may be in surface-contact with and accommodated in the coupling body 321. The coupling body 321 may have a cross-sectional shape corresponding to a cross-sectional shape of the rotation shaft 740.

The coupling body 321 may include an inner groove 322 into which the rotation shaft 740 is partially inserted and fixed, and the inner groove 322 may have an area corresponding to an area of the rotation shaft 740. An inner circumferential surface of the inner groove 322 may be in surface-contact with the rotation shaft 740. That is, the inner groove 322 may have the same shape as the cross-sectional shape of the rotation shaft 740, and may be coupled to and in contact with an outer circumferential surface of the rotation shaft 740.

In addition, the coupling body 321 may include a coupling plate 323 disposed inside the inner groove 322 to face the free end of the rotation shaft 740. The coupling plate 323 may be disposed to face a surface of the free end of the rotation shaft 740, and may contact and support the free end of the rotation shaft 740. The coupling plate 323 may determine a length at which the rotation shaft 740 is inserted into the shaft coupling portion 320. In addition, the coupling plate 323 may prevent the rotation shaft 740 from being excessively inserted even when the impact or the vibration is transmitted to the rotation shaft 740.

In addition, the coupling plate 323 may have a rotation shaft coupling groove 3231 defined therein through which a coupling member capable of being coupled to the free end of the rotation shaft passes. The coupling member may be coupled by passing through the rotation shaft coupling groove 3231 and passing through the rotation shaft 740.

Accordingly, it is possible to prevent the rotation shaft 740 from arbitrarily deviating or being removed from the bushing portion 300. In addition, even when the drum 200 vibrates in the front and rear direction, a position at which the coupling plate 323 is coupled to the rotation shaft 740 may be always fixed.

The inner groove 322 may firmly fix the rotation shaft 740 so as not to rotate in vain. To this end, a thread or a groove gear 3221 capable of improving a contact force with the rotation shaft 740 may be disposed on the inner circumferential surface of the inner groove 322.

A serration capable of being coupled to the groove gear 3221 may be disposed on the outer circumferential surface of the rotation shaft 740.

Accordingly, when the rotation shaft 740 rotates, the bushing portion 300 rotates at the same rpm as the rotation shaft 740, and the bushing portion 300 may rotate the drum 200.

In one example, when a cross-section of the rotation shaft 740 is not circular, but has a straight portion like a polygon or track shape, and when a cross-section of the inner groove 322 also has a shape corresponding to the shape of the cross-section of the rotation shaft 740, the rotational force and the rotation direction of the rotation shaft 740 may be immediately transmitted to the inner groove 322.

As a result, even when the rotation shaft 740 is rapidly accelerated or rapidly changes the rotation direction thereof, the inner groove 322 may be rapidly accelerated together with the rotation shaft 740 immediately, or may rapidly change the rotation direction thereof. As a result, the rotation of the drum 200 may be controlled together with the rotation shaft 740.

In one example, the coupling plate 323 may be spaced apart from both ends of the coupling body 321 by a certain length. That is, the coupling plate 323 may be located inside the coupling body 321, and an external groove may be defined at a free end of the coupling body 321 up to the coupling plate 323.

The free end of the coupling body 321 may accommodate the outer circumferential surface of the coupling member inserted into the coupling groove 3231 because of the external groove, and may block the coupling member from being exposed to the outside of the bushing portion 300.

In one example, the recessed surface 330 may be recessed by a first length B1 from the coupling surface 310. The first length B1 may be set to a length smaller than a diameter of the coupling surface 310 or a diameter of the recessed surface 330.

Accordingly, a depth of the rotation shaft 740 accommodated in the bushing portion 300 may be increased as much as the depth of the recessed surface 330 as well as the depth of the shaft coupling portion 320. Therefore, because the recessed surface 330 is located frontward (a direction of the laundry inlet 211) of the drum rear surface 220, the free end of the rotation shaft 740 may also be accommodated to be positioned frontward (the direction of the drum laundry inlet) of the drum rear surface 220. In other words, the rotation shaft 740 may be deeply coupled to the drum 200 to such an extent that the free end of the rotation shaft 740 is positioned inside the drum body 210.

As a result, even when the rotation shaft 740 rotates, the distortion of the drum body 210 may be eliminated, and the bushing portion 300 may receive the rotational force of the rotation shaft 740 more effectively.

In one example, the bushing portion 300 is only recessed into the drum body 210 from the drum rear surface 220 because of the recessed surface 330 and the shaft coupling portion 320, and the drum rear surface 220 is able to be disposed rearward (in the direction of the driver) of the free end of the rotation shaft 740 and the shaft coupling portion 320.

As a result, at the same time as an area where the rotation shaft 740 and the drum 200 are coupled to each other is increased, and the volume of the drum 200 may also be increased.

In one example, in the shaft coupling portion 320, the coupling body 321 may be provided to extend in a direction opposite to the recessed surface 330.

That is, when the recessed surface 330 extends away from the driver M from the coupling surface 310, the coupling body 321 may extend closer to the driver M from the inner circumferential surface of the recessed surface 330.

The coupling body 321 may extend from the inner circumferential surface of the recessed surface 330 to a length smaller than the length at which the recessed surface 330 extends from the coupling surface 310.

Therefore, the bushing portion 300 may be prevented from being excessively long, and may be coupled to the rotation shaft 740 as at least a portion of the rotation shaft 740 is accommodated in the recessed surface 330. That is, an inner space of the recessed surface 330 may be used as a space to which the rotation shaft 740 is coupled.

In one example, the coupling body 321 may further include a portion extending away from the driver M from the recessed surface 330. That is, the coupling body 321 may be provided to extend simultaneously in front and rear directions (directions away from and closer to the driver) from the inner circumferential surface of the recessed surface 330.

Figure 15:
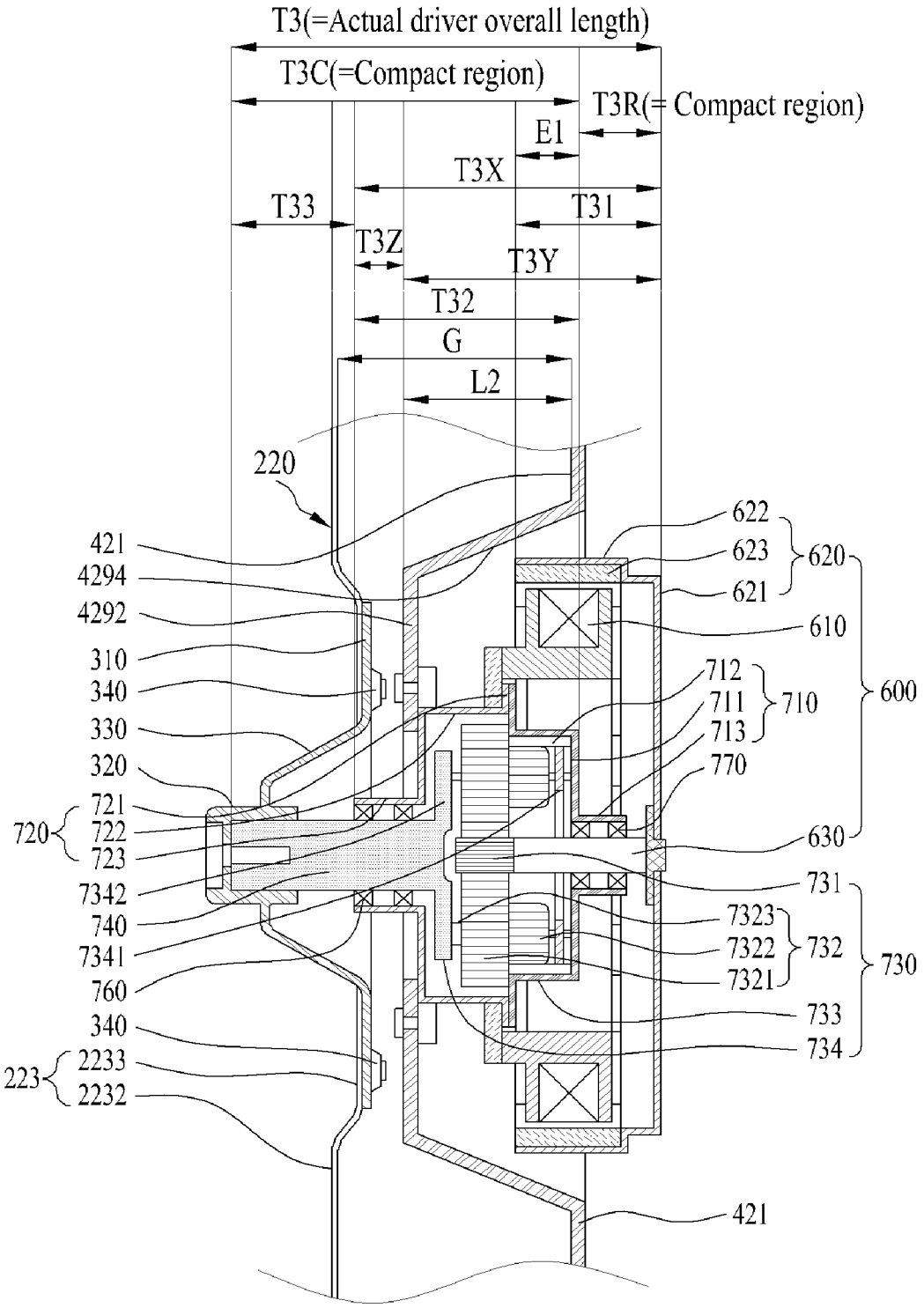
FIG. 15 shows a structure in which components of a driver of a laundry treating apparatus according to the present disclosure are compactly disposed.

FIG. 15 shows an embodiment in which the driver M is coupled to the drum 200.

The decelerator 700 may be fixedly coupled to the rear casing 420.

The motor 600 may be disposed at the rear of the rear casing 420 together with the decelerator 700, and the drum rear surface 220 may be disposed in front of the rear casing 420 and the decelerator 700.

The stator 610 of the motor 600 is disposed to be spaced apart from the rear casing 420, and the terminal 616 supplying the current to the stator 610 is able to be disposed proximate to the rear casing 420 or is able to be in contact with the rear casing 420, but is not coupled to and fixed to the rear casing 420.

The rotor 620 may include a permanent magnet 623 facing the stator 610, an installation body 622 to which the permanent magnet 623 is coupled, wherein the installation body 622 is disposed to be spaced apart from the outer circumferential surface of the stator 610, and a rotor body 621 extending from the installation body 622 and rotating while facing the stator 610. The rotor body 621 may be formed in a disk shape having a diameter larger than a diameter of the stator 610, and the installation body 622 may be provided such that the outer circumferential surface of the stator 610 is accommodated in the outer circumferential surface of the rotor body 621. The rotor body 621 may have the driving shaft 630 coupled to a center thereof, and a plurality of inlet holes that pass through a region between the driving shaft 630 and the installation body 622 to allow the air to be injected into the stator 610 may be defined.

The driving shaft 630 may be coupled to a stud 631 coupled to the center of the rotor body 621 and extend into the decelerator 700.

The washer 640 provided to rotatably support an inner surface of the rotor body 621 may be coupled to the driving shaft 630. The washer 640 may include a coupling washer 642 coupled to the driving shaft 630, and a support washer 641 for supporting the rotor body 621 from the coupling washer 642.

Because of the washer 640, the rotor 620 and the driving shaft 630 may be prevented from being distorted while rotating.

In one example, the washer 640 may not be coupled to the rotor 620, but may be coupled to the decelerator 700 to rotatably support the rotor 620.

The first housing 710 of the decelerator 700 may be disposed to face the rotor body 621, and the second housing 720 may be coupled to the first housing 710 to face the drum rear surface 220.

A gearbox 730 may be disposed inside the first housing 710 and the second housing 720. The gearbox 730 may include a sun gear 731 disposed at the free end of the driving shaft 630 or coupled to the free end of the driving shaft 630, at least one planetary gear 732 provided to rotate in engagement with the sun gear 731, a ring gear 733 coupled to an outer circumferential surface of the planetary gear 732 to induce rotation of the planetary gear 732, and a carrier 734 that rotatably supports the plurality of planetary gears 732.

The planetary gear 732 may be disposed along a circumference of the sun gear 731. Each planetary gear 732 may include a first planetary body 7321 rotating in engagement with the sun gear 731 and the ring gear 733, a second planetary body 7322 that may have a smaller diameter than the first planetary body 7321, and a gear shaft 7323 that supports the first planetary body 7321 and the second planetary body 7322 rotatable to the carrier 734.

When the sun gear 731 rotates, the planetary gear 732 rotates to rotate the gear shaft 7323, thereby rotating the carrier 734.

The carrier 734 may include a first carrier 7341 coupled to one end of the gear shaft 7323 and a second carrier 7342 coupled to the other end of the gear shaft 7323.

The first carrier 7341 and the second carrier 7342 may be formed in a ring shape or a disk shape.

In one example, the rotation shaft 740 may extend from a rotation center of the second carrier 7342. The rotation shaft 740 may be formed integrally with the second carrier 7342 or may be coupled to the second carrier 7342 and extend.

The first housing 710 may include a ring gear housing 711 provided to fix an outer circumferential surface of the first planetary body 7321 or an outer circumferential surface of the ring gear 733, a planetary gear housing 712 extending from the ring gear housing 711 to rotatably accommodate the second planetary body 7322 and the first carrier 7341, and a shaft accommodating portion 713 extending from the planetary gear housing 712 to rotatably support the driving shaft 630.

The ring gear housing 711 may form a side surface of the first housing 710, and the planetary gear housing 712 may form at least a portion of the side surface and a surface facing the rotor 620 of the first housing 710. The shaft accommodating portion 713 may be formed in a shape of a pipe extending inwardly of the planetary gear housing 712.

The shaft accommodating portion 713 may be disposed in a space defined as the second planetary body 7322 has a smaller diameter than that of the first planetary body 7321. A driving bearing 770 for rotatably supporting the driving shaft 630 may be included on an inner circumferential surface of the shaft accommodating portion 713. The driving bearing 770 may include a plurality of the driving bearings disposed to be spaced apart from each other along a longitudinal direction of the driving shaft 630.

Accordingly, the driving bearing 770 and the shaft accommodating portion 713 do not protrude outside the decelerator 700, but are disposed inside the decelerator 700 to reduce a length of a space in which the driving shaft 630 is disposed. That is, a volume of the decelerator 700 itself may be reduced, and a distance between the decelerator 700 and the motor 600 may also be reduced.

Accordingly, the overall thickness of the driver M may be reduced, and the driving shaft 630 may be prevented from being distorted by coupling the stator 610 closer to the decelerator 700.

In addition, as the driving bearing 770 and the shaft accommodating portion 713 are disposed inside the decelerator 700, the driving shaft 630 becomes closer to the decelerator 700, so that the decelerator 700 may be accommodated and disposed inside the stator 610. As a result, at least a portion of the decelerator 700 may be disposed by utilizing the space of the motor 600.

As a result, the length of the drum 200 disposed between the rear casing 420 and the front casing 410 may be further extended, and the volume of the drum 200 may be enlarged.

In one example, the second housing 720 may include the coupling body 721 coupled to the ring gear housing 711, the blocking body 722 provided to shield the gearbox 730 from the coupling body 721, and the shaft support 723 extending from the blocking body 722 to rotatably support the rotation shaft 740. The shaft support 723 may be formed in a pipe shape extending from the blocking body 722, and a shaft bearing 760 for rotatably supporting the rotation shaft 740 may be installed inside the shaft support 723.

The shaft bearing 760 may include a plurality of shaft bearings spaced apart from each other at a certain distance along a longitudinal direction of the rotation shaft 740.

The free end of the rotation shaft 740 may be inserted into and coupled to the drum rear surface 220. In this connection, the rotation shaft 740 and the drum rear surface 220 may be disposed as close to each other as possible. At least one of the shaft bearings 760 may be disposed frontward of the drum rear surface 220.

When the driving shaft 630 is rotated by the rotor 620, the sun gear 731 rotates, and the planetary gear 732 rotates in engagement with the sun gear 731. The first planetary body 7321 rotates in engagement with the ring gear 733, but, because the ring gear 733 is fixed, the first planetary body 7321 rotates along a circumference of the sun gear 731 by reaction.

The planetary gear 732 rotates the gear shaft 7323, and consequently rotates the carrier 734. When the carrier 734 rotates, a rotation shaft 740 extending from the second carrier 7342 rotates.

In this connection, because the planetary gear 732 is engaged with the sun gear 731, even when the planetary gear 732 rotates in an opposite direction in engagement with the sun gear 731, the carrier 734 rotates in the same direction as the sun gear 731 by a reaction as the planetary gear 732 rotates with respect to the ring gear 733, and consequently, the rotation shaft 740 rotates in the same direction as the sun gear 731.

In one example, because a diameter of the outer circumferential surface of the planetary gear 732 and a diameter of the carrier 734 are larger than a diameter of the sun gear 731, the rotation shaft 740 rotates at a smaller rpm than the sun gear 731. Accordingly, the rotation shaft 740 rotates at a smaller rpm than the driving shaft 630. However, because energy is not wasted other than friction loss, the power transmitted to the driving shaft 630 may be transmitted to the rotation shaft 740. Accordingly, as the rpm of the rotation shaft 740 is reduced, the torque, which is the rotational force, may be amplified.

Because the decelerator 700 converts power corresponding to a low torque and a high rpm generated by the motor 600 into power corresponding to a high torque and a low rpm, it may be defined that the decelerator 700 converts the power of the motor 600 and transmits the converted power to the drum 200.

In one example, an axial direction of the driving shaft 630 and an axial direction of the rotation shaft 740 may be coaxial with each other. In this connection, because the driving shaft 630 is supported inside the decelerator 700, and the stator 610 is also fixedly coupled to the decelerator 700, a direction formed by the driving shaft 630 with the decelerator 700 may be almost always maintained.

In this connection, because the gearbox 730 is fixed inside the decelerator 700 in a gear coupling scheme, and the rotation shaft 740 is also fixed by the decelerator housing 720 and the bearing 770 in the gearbox 730, a direction in which the rotation shaft 740 extends from the decelerator 700 may almost always be maintained. Accordingly, the rotation shaft 740 and the driving shaft 630 may almost always remain coaxial with each other. The rotation shaft 740 and the driving shaft 630 may tilt together with the decelerator housing or vibrate simultaneously with the decelerator housing.

The rotation shaft 740 is coupled to the bushing portion 300 by being supported by the shaft support 723 extending from the second housing 720. Specifically, the rotation shaft 740 may be rotatably supported by the at least one first bearing 760 disposed on the inner circumferential surface of the shaft support 723, and the free end of the rotation shaft 740 may be inserted into and fixed to the shaft coupling portion 320.

Hereinafter, a structure capable of securing the length of the drum 200 by minimizing the space independently occupied by the driver M inside the cabinet will be described below.

The total length T3 of the driver M may correspond to a length from the rear surface of the rotor 620 to the free end of the rotation shaft 740. In this connection, when the driver M independently occupies a volume corresponding to the total length T3 in the cabinet 100, the drum length T2 at which the drum 200 may be disposed inside the cabinet 100 is reduced, so that the volume that may accommodate the laundry may be reduced, and space utilization inside the cabinet 100 may be greatly reduced.

Therefore, the laundry treating apparatus according to the present disclosure may compactly dispose the components of the driver M, or may reduce the space the driver M occupies independently with the drum 200 or the rear casing 420, thereby setting the total length T3 of the driver M to be smaller than a sum of thicknesses of the components of the driver M.

First, the total length T3 of the driver M may be set to be smaller than a sum of a thickness T31 of the motor 600 corresponding to a thicknesses of the stator 610 and the rotor 620, a thickness T32 of the entirety of the decelerator 700, and a length T33 of a portion of the rotation shaft 740 exposed to the outside from the decelerator 700.

Specifically, the decelerator 700 may be at least partially accommodated in the stator 610. That is, the decelerator 700 may be disposed utilizing the internal space of the stator 610, and may be accommodated in the stator 610 by an overlapping length E1. The overlapping length E1 may correspond to a length from the fastening portion 728 to the shaft accommodating portion 713.

As a result, an actual length T3X of the motor 600 and the decelerator 700 may be set to be smaller than a sum of the thickness T31 of the motor 600 and the length T32 of the decelerator by the overlapping length E1. Therefore, the space occupied by the motor 600 and the decelerator 700 may be reduced by the overlapping length El first.

The overlapping length E1 corresponds to a length reduced by the decelerator 700 and the motor 600 by themselves.

The driver M may reduce the occupying length thereof through a placement relationship with another component.

Because the decelerator 700 is coupled to and supported by the rear casing 420, and the motor 600 is not fixed to the rear casing 420, the decelerator 700 and the motor 600 are positioned on the rear surface of the rear casing 420. A length occupied by the driver 600 and the decelerator 700 in the rear casing 420 may be defined as an installation length T3Y.

In this connection, the drum 200 is disposed in front of the rear casing 420 to be spaced apart from the rear casing 420 by a separation distance G so as not to interfere with the rear casing 420 during the rotation.

As a result, the decelerator 700 and the motor 600 are disposed to occupy an independent space as much as the installation length T3Y on the rear surface of the rear casing 420, and are spaced apart from the drum 200 by the separation distance G, the length T3 occupied by the driver M may include at least a sum of the installation length T3Y and the separation distance G when considering the length T33 of the rotation shaft 740.

In order to reduce the length T3 of the driver M, the rear casing 420 may be provided such that the mounting portion 429 is recessed toward the drum rear surface 220 or the bushing portion 300 by an accommodation depth L2. In addition, a diameter of the mounting portion 429 may be larger than that of the rotor 620. That is, from the rear plate 421 to the mounting surface 4292, the mounting groove 4294 may be recessed or inclinedly extended by the accommodation depth L2. Accordingly, the mounting portion 429 may secure a space for accommodating at least one of the decelerator 700 and the motor 600.

When the decelerator 700 and the motor 600 are accommodated and disposed in the mounting portion 429, the decelerator 700 and the motor 600 may be disposed closer to the drum rear surface 220 by the accommodation depth L2 than to the rear plate 421.

As a result, the installation length T3Y of the decelerator 700 and the motor 600 may overlap the separation distance G, and the decelerator 700 and the motor 600 may be disposed to at least partially overlap each other in a space corresponding to the separation distance G.

Therefore, portions of the motor 600 and the decelerator 700 of a volume corresponding to the accommodation depth L2 of the installation lengths T3Y may be disposed in the space corresponding to the separation distance G.

As a result, the space the motor 600 and the decelerator 700 use independently of the drum 200 inside the cabinet 100 may be reduced by the accommodation depth L2.

In addition, because the decelerator 700 becomes closer to the drum 200 by the accommodation depth L2 because of the mounting portion 490, the length T33 of the rotation shaft 740 may be further reduced by that much, so that the overall driver length T3 may be reduced.

In one example, at least a portion of the gearbox 730 of the decelerator 700 may be made of a non-metal material. For example, at least one of the sun gear 731, the planetary gear 732, the ring gear 733, and the carrier 734 may be made of a non-metal material or a resin-based material.

When the sun gear 731, the planetary gear 732, the ring gear 733, and the carrier 734 are made of a solid metal material, even when the sun gear 731, the planetary gear 732, the ring gear 733, and the carrier 734 are formed in a small size, durability may be ensured, and the power may be transmitted as it is, so that reliability of the decelerator 700 may be increased.

However, when the sun gear 731, the planetary gear 732, the ring gear 733, and the carrier 734 are made of the metal material, as a weight of the gearbox 730 increases, not only is it more difficult to fix or support the decelerator 700 inside the cabinet 100, but also heat generated from the motor 600 is transferred to the gearbox 730 as it is, so that the decelerator 700 may be overheated.

In addition, when the sun gear 731, the planetary gear 732, the ring gear 733, and the carrier 734 are all made of the metal material, the vibration transmitted to the rotation shaft 740 or the driving shaft 630 is transmitted as it is, so that one of the sun gear 731, the planetary gear 732, the ring gear 733, and the carrier 734 may be damaged, or the rotation shaft 740 or the driving shaft 630 may be distorted.

Accordingly, at least one of the sun gear 731, the planetary gear 732, the ring gear 733, and the carrier 734 may be made of the non-metal material. For example, at least one of the rotation shaft 740 and the driving shaft 630 may be made of the resin-based material such as reinforced plastic.

Thus, not only a load of the gearbox 730 itself may be reduced, but also the heat transfer from the motor 600 may be blocked, and the vibration transmitted to the sun gear 731, the planetary gear 732, the ring gear 733, and the carrier 734 may be partially buffered.

However, when at least one of the sun gear 731, the planetary gear 732, the ring gear 733, and the carrier 734 is made of the non-metal material, a volume thereof may become larger than a volume thereof in the case of being made of the metal material, and the decelerator thickness T32 may be increased.

In this connection, because the mounting portion 429 is recessed from the rear plate 421 by the accommodation depth L2, the increased decelerator thickness T32 may be sufficiently buffered. Moreover, the bushing portion 300 may accommodate the rotation shaft 740 or the shaft support 723 of the decelerator 700 through the recessed surface 330 to reduce the increased decelerator thickness T32.

In one example, when the rotation shaft 740 is excessively shortened, because an area the rotation shaft 740 is coupled to the drum 200 or the bushing portion 300 is not able to be sufficiently secured, there may be a problem that the power generated from the driver M is not able to be transmitted to the drum 200.

Even so, when the rotation shaft 740 is formed to be long, an adverse effect of increasing the total length T3 of the driver M may occur.

Accordingly, the laundry treating apparatus according to the present disclosure includes the bushing portion 300 including the recessed surface 330 that may be recessed into the drum 200. The bushing portion 300 allows the shaft coupling portion 320 to be positioned inside the drum 200 because of the recessed surface 330.

As a result, the rotation shaft 740 extending from the decelerator 700 may be supported and coupled to the shaft coupling portion 320 even when the length thereof is sufficiently secured, and may be located inside the drum 200 because of the recessed surface 330.

Accordingly, a portion of the rotation shaft 740 corresponding to at least a portion of the length T33 of the rotation shaft 740 is disposed inside the drum 200 because of the bushing portion 300, so that the space occupied by the rotation shaft 740 independently of the drum 200 may be reduced.

In one example, the decelerator 700 may be provided such that the shaft support 723 supporting the rotation shaft 740 passes through the mounting portion 429.

That is, the shaft support 723 may extend from the second housing 720 located on the rear surface of the mounting portion 429 toward the bushing portion 300 by an extension length T3Z.

As a result, the actual length T3X of the decelerator 700 and the motor 600 may be a value obtained by adding the installation length T3Y and the extension length T3Z.

As a result, the decelerator 700 and the bushing portion 300 may also become closer to each other, and the length of the rotation shaft 740 may be further reduced by that much.

The extension length T3Z may correspond to a length extended from the second housing 720 such that at least a portion of the shaft support 723 may be disposed inside the bushing portion 300. For example, the shaft support 723 may be disposed inside the recessed surface 330 such that at least one of the first bearings 760 disposed on the inner circumferential surface of the shaft support 723 may be disposed inside the bushing portion 300.

The extension length T3Z may overlap the separation length G. Specifically, the extension length T3Z may overlap a length at which the mounting portion 429 and the bushing portion 300 are spaced apart from each other, and may be larger than the length at which the mounting portion 429 and the bushing portion 300 are spaced apart from each other.

Accordingly, because a portion of the decelerator 700 is located inside the bushing portion 300, the thickness that the decelerator 700 itself occupies independently of the drum 200 may be further reduced by an overlapping length of the extension length T3Z and the bushing portion 300.

In addition, because the shaft support 723 is spaced apart from the decelerator 700 by the extension length T3Z, a portion of the rotation shaft 740 with the length T33, which is the length the rotation shaft 740 extends from the decelerator 700 and occupies independently of the decelerator 700, may be disposed only inside the drum 200.

As a result, the driver M may not be completely spaced apart from and disposed independently of the rear surface of the drum 200. Accordingly, the components of the driver M may be disposed in a maximally compact manner by utilizing the spaces as much as the accommodation depth L2 of the mounting portion 492, the depth B1 of the recessed surface 330, and the extension length T3Z of the shaft support 723. As a result, the driver M may occupy the space in the cabinet only as much as an exposed thickness T3R of the rear plate 421 from the rear surface.

In other words, the driver M may secure a compact region T3C in which the driver M may not be exposed to the rear surface of the rear casing 420 through at least one of utilization of the space inside the stator 610, utilization of the space between the drum rear surface 220 and the rear casing 420 by the mounting portion 429, utilization of the space between the decelerator 700 and the drum 200 by the shaft support 723, and utilization of the space inside the drum body 210 by the bushing portion 300.

Accordingly, the thickness occupied by the driver M inside the cabinet is only the exposed thickness T3R, which is a thickness of the region exposed from the rear casing 420, excluding the thickness corresponding to the compact region T3C from the thickness T3 of the entire driver M.

Accordingly, the driver M may additionally occupy only the exposed thickness T3R within the length T1 allowed inside the cabinet 100 and may not independently occupy the compact thickness T3C, and the length T2 of the drum may be secured larger by the maximum thickness T3C of the compact region.

Figure 16:
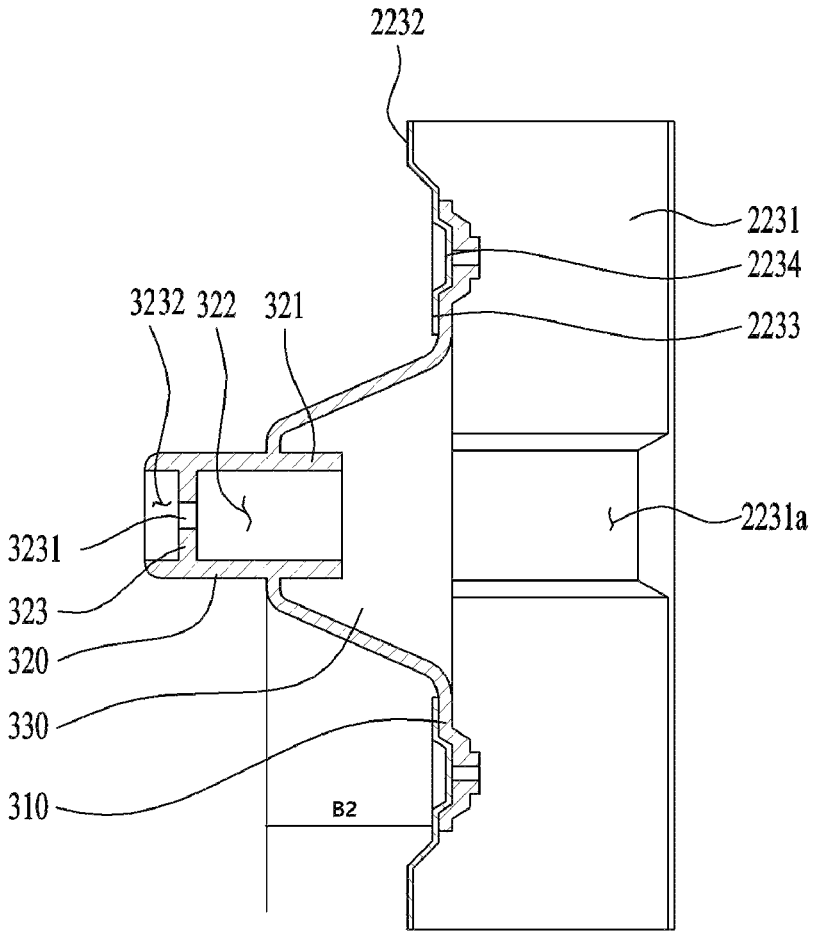
FIG. 16 shows another embodiment of a bushing and a drum rear surface of a laundry treating apparatus according to the present disclosure.

FIG. 16 shows another embodiment of the bushing portion 300 and the drum rear surface 220.

The bushing portion 300 may include the coupling surface 310 that may be seated on the drum rear surface 220, the shaft coupling portion 320 that may be coupled to the rotation shaft 740, and the recessed surface 330 that induces the shaft coupling portion 320 to be positioned frontward of the drum rear surface 220. In this connection, the recessed surface 330 may extend from the coupling surface 310 by a second length B2 that is set to be larger than at least one of a diameter of the coupling surface 310, a diameter of the mounting hole 222, and a diameter of the recessed surface 330. That is, the recessed surface 330 may extend deeper into the drum body 210 to accommodate more of the rotation shaft 740 therein. Accordingly, a length occupied by the rotation shaft 740 outside the drum rear surface 220 may be further reduced, and the additional region occupied by the driver M may be further reduced.

In one example, on the drum rear surface 220, the accommodating surface 2231 may extend from the circumferential portion 221 by a length larger than the second length B2. A diameter of the accommodating surface 2231 may be greater than the diameter of the rotor 620 or the stator 610, and may be greater than the diameter of the mounting portion 429. As such, the drum rear surface 220 may be provided to accommodate at least a portion of the mounting portion 429 by the accommodating surface 2231.

The accommodating surface 2231 may further include an electric wire avoidance groove 2231*a* that is recessed outward to avoid the electric wire support groove 4295 defined in the mounting portion 429.

In addition, the seating portion 223 may utilize a space inside the accommodating surface 2231 to reduce the space occupied by the bushing portion 300 inside the drum body 210 as much as possible. In other words, the bushing portion 300 may reduce the overall length of the driver M by utilizing the interior of the drum body 210 as the space for accommodating the rotation shaft 740, but the seating portion 223 may be provided such that the space occupied by the bushing portion 300 inside the drum body 210 may also be reduced.

To this end, the seating portion 223 may be provided to rather protrude such that the installation surface 2233 on which the bushing portion 300 is seated in the support surface 2232 becomes closer to the driver M. In other words, the installation surface 2233 may protrude in a direction opposite to the direction in which the accommodating surface 2231 is recessed and extended from the support surface 2232.

The coupling surface 310 of the bushing portion 300 may be disposed closer to the driver M than to the support surface 2232 because the installation surface 2233 protrudes outward of the drum rear surface 220 from the support surface 2232.

The coupling groove 2234 may further protrude from the installation surface 2233 toward the driver M, and the bushing coupling portion 312 may be provided to accommodate the coupling groove 2234 therein, so that the bushing portion 300 may be more firmly fixed to the seating portion 223.

In addition, because the installation surface 2233 is provided to be bent into the support surface 2232, the load of the bushing portion 300 is distributed, so that the rigidity of the seating portion 223 may be further strengthened. In addition, the coupling groove 2234 also protrudes from the installation surface 2233 to not only reinforce the rigidity of the coupling surface 310, but also firmly support the fastening member that may be fastened through the coupling groove 2234.

Figure 17:
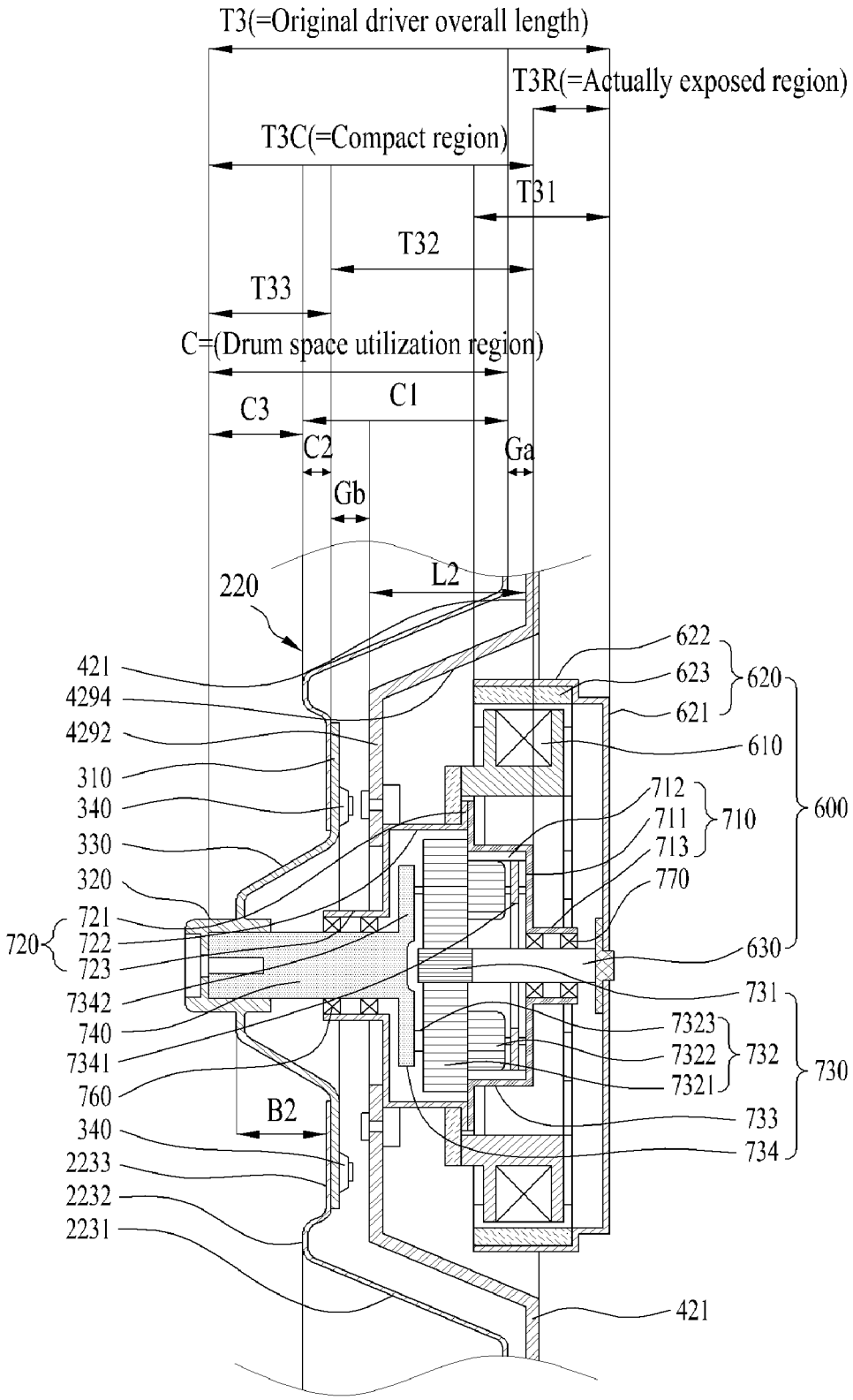
FIG. 17 shows a structure in which components disposed at the rear of a drum of a laundry treating apparatus according to the present disclosure are compactly disposed.

FIG. 17 shows an embodiment in which the driver M is coupled to the drum rear surface 220 having the seating portion 223 and the installation surface 2233.

As seen in FIG. 15 above, the laundry treating apparatus according to the present disclosure is provided such that the total thickness T3 of the driver M is smaller than the sum of the thickness T31 of the stator 610 or the motor 600, the thickness T32 of the decelerator 700, and the thicknesses T33 of the rotation shaft 740. This is because the stator 610, the decelerator 700, and the rotation shaft 740 are compactly disposed to reduce the total thickness of the driver M.

For example, the decelerator 700 is disposed in the internal space of the stator 610, so that the installation spaces of the stator 610 and the decelerator 700 overlap. Accordingly, the total thickness of the motor 600 and the decelerator 700 is smaller than the sum of the thickness of the motor 600 and the thickness of the decelerator 700, so that the region occupied by the driver M itself may be reduced. Accordingly, the length T2 of the drum may be increased by the overlapping length of the motor 600 and the decelerator 700.

In addition, in the mounting portion 429, the mounting surface 4292 is recessed by the accommodation depth L2 from the rear plate 421 toward the drum rear surface 220 through the mounting groove 4294. Therefore, even when the decelerator 700 and the motor 620 are disposed on the rear surface of the rear plate 420, the decelerator 700 and the motor 620 may be disposed to be closer to the drum 200 by the accommodation depth L2.

Accordingly, the driver M may reduce the thickness thereof by itself to reduce the occupied volume thereof, as well as utilize the empty space between the drum rear surface 220 and the rear plate 420. Therefore, because the driver M may utilize the space between the drum rear surface 220 and the rear plate 420, the rear panel 120 disposed on the rear surface of the driver M may be disposed closer to the rear plate 420.

The laundry treating apparatus according to the present disclosure means that the rear plate 421 may be disposed closer to the rear panel 120 than the rear casing 420. Accordingly, because the rear plate 421 may be disposed rearwardly by the accommodation depth L2, the length T2 of the drum may be further increased by the accommodation depth L2.

So far, the description has been focused on disposing the components of the driver M compactly by maximizing the region defined at the rear of the drum rear surface 220.

In addition, the laundry treating apparatus according to the present disclosure may utilize the inner space of the drum body 210 to compactly dispose the driver M toward the drum 200.

The laundry treating apparatus according to the present disclosure may dispose the space occupied by the drum 200 and the space occupied by the rear casing 420 or the space occupied by the driver M to overlap as much as possible. Accordingly, the space occupied by all of the drum 200, the rear casing 420, and the driver M may be saved.

For example, the laundry treating apparatus according to the present disclosure may dispose the driver M inside the drum body 210 or in a portion of the laundry accommodation space. As a result, the space occupied by the driver M in the cabinet 100 independently of the drum 200 may be reduced.

Specifically, the laundry treating apparatus according to the present disclosure may use a portion of the space occupied by the drum 200 inside the cabinet 100 as a drum space utilization region C in which at least one of the bushing portion 300, the driver M, and the rear casing 420 may be at least partially disposed.

The drum space utilization region C may correspond to a region, which is the portion of the laundry accommodation space inside the drum 200 utilized as the space in which at least one of the bushing portion 300, the driver M, and the rear casing 420 may be disposed.

The drum space utilization region C may include a space defined by the seating portion 223 recessed toward the laundry inlet 211 of the drum from the drum rear surface 220.

The seating portion 223 may be recessed by a utilization length C1 from the drum rear surface 220. That is, the accommodating surface 2231 of the seating portion 223 may extend obliquely toward the laundry inlet 211 by the utilization length C1 from the inner circumferential surface of the circumferential portion 221. Accordingly, a space corresponding to the utilization length C1 defined in the outer surface of the drum rear surface 220 may be included in the drum space utilization region C.

The accommodating surface 2231 may have a diameter larger than the diameter of the mounting portion 429. Thus, the accommodating surface 2231 may accommodate at least a portion of the mounting portion 429, and one surface of the accommodating surface 2231 and at least one surface of the mounting portion 429 may be disposed to face each other. Accordingly, a portion of the rear casing 420 may be disposed in the drum space utilization region C.

The separation distance G between the drum rear surface 220 and the rear casing 420 may be diversified because of the drum space utilization region C. For example, the circumferential portion 221 and the rear casing 420 may be spaced apart from each other by a first gap Ga, and the support surface 2232 and the mounting surface 4292 may be spaced apart from each other by a second gap Gb, which is set to be larger than the first gap Ga.

In other words, the second gap Gb between the support surface 2232 and the mounting surface 4292 may be secured relatively large, but the first gap Ga independent of driver M may be set to be relatively small, so that the separation space G between the drum 200 and the rear casing 420 may be efficiently utilized.

In one example, the decelerator 700 or the motor 600 may be accommodated and mounted in the mounting portion 429. Thus, when the mounting portion 429 is accommodated in the accommodating surface 2231, at least a portion of the decelerator 700 and the motor 600 may be disposed in the drum space utilization region C.

As a result, at least a portion of the driver M is disposed in the drum space utilization region C, so that the exposed region T3R that the driver M independently occupies at the rear of the drum 200 may be reduced as much as possible.

In one example, a space outside the drum space utilization region C may be viewed as a space utilized by the drum 200. In other words, in terms of the drum, because the drum rear surface 220 may be disposed at a more rearward position, which is a location of the region in which the driving unit M is disposed or the side surface of the driving unit M, the length T2 of the drum may be further extended.

The drum 200 accommodates a portion or the entirety of the driver M through the seating portion 223, so that the drum rear surface 220 may be disposed at a location more rearward than the front surface of the driver M. As a result, the drum length T2 may be increased as much as possible, and the internal volume of the drum may be further extended by a region corresponding to the accommodation length C1.

As a result, because of the drum space utilization region C, the laundry treating apparatus according to the present disclosure may not only install the components of the driver M compactly, but also secure a drying volume as large as possible.

The drum space utilization region C may further include a space occupied by the bushing portion 300 in the drum rear surface 220.

Because the bushing portion 300 is a member coupled to the rotation shaft 740, when the bushing portion 300 protrudes from the drum rear surface 220 and is coupled to the rotation shaft 740, the bushing portion 300 may be disposed at a location rearward of the drum rear surface 220 by the accommodation length C1.

However, rather than placing the space occupied by the bushing portion 300 outside the drum 200, the space occupied by the bushing portion 300 may be placed inside the drum 200 to reduce the space occupied by the bushing portion 300 independently.

In the bushing portion 300, when the coupling surface 310 is coupled to the drum rear surface 220, the recessed surface 330 may extend inwardly of the drum body 210 by the first length B1 or the second length B2 from the drum rear surface 220. Furthermore, the shaft coupling portion 320 that accommodates the rotation shaft 740 therein may further extend in the direction of the laundry inlet 211 on the inner circumferential surface of the recessed surface 330.

Specifically, the recessed surface 330 and the shaft coupling portion 320 may be located inside the drum inside 200 as much as a total bushing length C3, and the drum space utilization region C may be more expanded.

As a result, because the bushing portion 300 is disposed inside the drum 200 as much as the bushing length C3, the volume occupied by the bushing portion 300 independently from the drum 200 may be reduced as much as possible.

Accordingly, a length of the space independently occupied by the bushing portion 300 of the allowable length T1 is reduced, so that the space for securing the driver M may be increased or the drum length T2 may be further increased.

In one example, the bushing length C3 of the bushing portion 300 may be viewed as a length of the rotation shaft 740 accommodated inside the drum 200. That is, the rotation shaft 740 may be accommodated in the drum 200 as much as the bushing length C3, so that the drum 200 and the driver M may be compactly disposed to be closer to each other.

Therefore, the length of the rotation shaft 740 extending from the decelerator second housing 720 may be reduced, and the rotation shaft 740 may be prevented from being distorted in the decelerator 700 as much as possible.

From the viewpoint of the drum 200, because the bushing length C3 is included in the drum space utilization region C, the drum rear surface 220 may be disposed further rearward than the free end of the rotation shaft 740. Accordingly, the drum 200 may utilize a space in which the rotation shaft 740 extends from the drum rear surface 220 and is independently disposed as the laundry accommodating space.

That is, the drum length T2 may be secured larger.

In one example, the installation surface 2233 may further protrude from the support surface 2232 toward the outside of the drum rear surface 220 by a secured length C2. As a result, the secured length C2 may overlap the accommodation length C1. Because of the secured length C2, a space corresponding to the accommodation length C1 may be double used as a space in which the driver M or the mounting portion 429 is disposed and a space in which the bushing portion 300 is disposed.

Thus, the region corresponding to the accommodation length C1 may correspond to the space in which the driver M, the mounting portion 429, and the drum 200 are installed to overlap each other, and may correspond to a space in which the bushing portion 300 and the drum 200 are installed to overlap each other.

Because the installation surface 2233 is located on the inner circumferential surface of the support surface 2232, the diameter of the installation surface 2233 is smaller than the diameters of the outer circumferential surface of the support surface 2232 and the accommodating surface 2231. In addition, the secured length C2 is smaller than the accommodation length C1. This is to prevent the installation surface 2233 from being excessively bent on the support surface 2232 and at the same time to prevent the installation surface 2233 from rather interfering with the driver M.

Accordingly, a volume of the region corresponding to the secured length C2 in the drum rear surface 220 is smaller than a volume of the region corresponding to the accommodation length C1 in the drum rear surface 220.

In one example, as the installation surface 2233 protrudes from the support surface 2232 to have the secured length C2, The coupling surface 310 of the bushing portion 300 may be disposed closer to the mounting portion 429 and may be disposed closer to the decelerator 700.

As a result, the length of the rotation shaft 740 may be further reduced, and the drum rear surface 220 and the decelerator 700 may become closer to each other. For example, the rotation shaft 740 may be disposed close to the drum rear surface 220 to such an extent that the first bearing 760 supporting the rotation shaft 740 in the decelerator 700 is positioned inside the recessed surface 330.

For this reason, it may be further ensured that the rotation shaft 740 and the driving shaft 630 are installed in parallel with each other, and a possibility that the rotation shaft 740 is bent or damaged even under the load of the drum 200 and the laundry may be blocked.

Putting this together, because of the drum space utilization region C, it is possible to dispose the components of the driver M compactly toward the drum rear surface 220.

It is possible to allow the decelerator 700 and the motor 600 to approach the drum rear surface 220 by the accommodation length C1, and the decelerator 700 and the motor 600 is able to be closer to the installation surface 2233 by the secured length C2.

In addition, by moving the free end of the rotation shaft 740 toward the drum 200 by the bushing length C3, the decelerator 700 and the motor 600 may approach the drum rear surface 220.

Accordingly, a length of the region independently occupied by the driver M in the cabinet at the rear of the drum rear surface 220 of the actual length T3 of the driver M may be reduced to the length of the actually exposed region T3R. The actually exposed region T3R may correspond to a region in which the driver M protrudes more rearward than the rear plate 421 and is exposed.

A thickness of the actually exposed region T3R may be less than ½ or ⅓ of the total thickness T3 of the driver M, so that the driver length T3 occupied by the driver of the allowable length T1 may be shortened by that amount, and the drum length T2 may be further increased.

The present disclosure is able to be implemented in various forms, so that a scope thereof is not limited to the above-described embodiment. Therefore, when the modified embodiment includes the components in claims of the present disclosure, the modified embodiment should be viewed as belonging to the scope of the present disclosure.

The invention claimed is:

1. A laundry treating apparatus comprising:

a drum configured to accommodate laundry therein; and a driver including a rotation shaft configured to rotate the drum, wherein the drum includes:

a drum body having a laundry inlet and defining a space configured to accommodate the laundry through the laundry inlet, a drum rear surface coupled to the drum body, and a bushing portion coupled to the drum rear surface, wherein a free end of the rotation shaft is coupled to the bushing portion, wherein the bushing portion includes:

a coupling surface coupled to an outer surface of the drum rear surface, and a shaft coupling portion extending from the coupling surface, wherein the free end of the rotation shaft of the driver is coupled to the shaft coupling portion, wherein at least a portion of the shaft coupling portion is inserted into the drum rear surface and disposed ahead of the drum rear surface, and wherein a free end of the rotation shaft is coupled to the shaft coupling portion ahead of the drum rear surface.

2. The laundry treating apparatus of claim 1, wherein the drum rear surface includes:

a circumferential portion coupled to the drum body; and a seating portion extending from the circumferential portion and being coupled to the bushing portion.

3. The laundry treating apparatus of claim 2, wherein the seating portion is recessed toward the laundry inlet from an inner circumferential surface of the circumferential portion.

4. The laundry treating apparatus of claim 3, wherein a diameter of the seating portion is larger than a diameter of the driver.

5. The laundry treating apparatus of claim 4, wherein at least a portion of the driver is received in the seating portion.

6. The laundry treating apparatus of claim 2, wherein the seating portion of the drum rear surface includes:

an accommodating surface extending obliquely from the circumferential portion of the drum rear surface;

a support surface extending from an inner circumferential surface of the accommodating surface and facing the driver; and an installation surface disposed at an inner circumferential surface of the support surface, wherein the bushing portion is seated at the installation surface.

7. The laundry treating apparatus of claim 6, wherein the installation surface further includes a coupling groove, wherein a fastening member is coupled to the coupling groove and support the bushing portion or pass through the bush portion.

8. The laundry treating apparatus of claim 1, wherein the shaft coupling portion receives the free end of the rotation shaft.

9. The laundry treating apparatus of claim 1, wherein the bushing portion further includes a recessed surface extending from the coupling surface toward the laundry inlet, wherein the shaft coupling portion of the bushing portion extends from an inner circumferential surface of the recessed surface of the bushing portion.

10. The laundry treating apparatus of claim 1, wherein a first gear is disposed at the free end of the rotation shaft of the driver, and wherein a second gear is disposed at the shaft coupling portion of the bushing portion and meshed with the first gear disposed at the free end of the rotation shaft of the driver.

11. The laundry treating apparatus of claim 1, wherein the shaft coupling portion of the bushing portion includes:

a coupling plate facing the free end of the rotation shaft of the driver; and a coupling member passing through the coupling plate and coupled to the free end of the rotation shaft of the driver.

12. The laundry treating apparatus of claim 1, wherein the coupling surface of the bushing portion is coupled to an outer surface of a seating portion of the drum rear surface.

13. The laundry treating apparatus of claim 12, further comprising a plurality of fastening members configured to couple the coupling surface of the bushing portion to the seating portion of the drum rear surface.

14. The laundry treating apparatus of claim 13, wherein the bushing portion further includes a plurality of bushing coupling portions that radially extend from the coupling surface of the bushing portion, wherein the plurality of fastening members is coupled to and supported by the plurality of bushing coupling portions respectively.

15. The laundry treating apparatus of claim 2, wherein the bushing portion is made of a material different from a material of the seating portion of the drum rear surface.

16. The laundry treating apparatus of claim 1, wherein the driver includes:

a stator configured to generate a rotating magnetic field;

a rotor configured to be rotated by the rotating magnetic field;

a driving shaft configured to be rotated by the rotor; and a decelerator coupled to the driving shaft and configured to change a rotational speed and torque of the driving shaft and allow the rotation shaft of the driver to rotate based on the changed rotational speed and torque of the driving shaft.

17. The laundry treating apparatus of claim 1, further comprising a hot air supplier disposed outside the drum and configured to supply hot air into the drum.

* * * * *